US007021745B2

(12) United States Patent
Silverbrook

(10) Patent No.: US 7,021,745 B2
(45) Date of Patent: Apr. 4, 2006

(54) INK JET WITH THIN NOZZLE WALL

(75) Inventor: Kia Silverbrook, Balmain (AU)

(73) Assignee: Silverbrook Research Pty Ltd, Balmain (AU)

( * ) Notice: Subject to any disclaimer, the term of this patent is extended or adjusted under 35 U.S.C. 154(b) by 340 days.

(21) Appl. No.: 09/798,741

(22) Filed: Mar. 2, 2001

(65) Prior Publication Data

US 2001/0008407 A1 Jul. 19, 2001

Related U.S. Application Data

(63) Continuation-in-part of application No. 09/113,095, filed on Jul. 10, 1998.

(30) Foreign Application Priority Data

Jul. 15, 1997 (AU) ..... PO8002

(51) Int. Cl.
*B41J 2/04* (2006.01)

(52) U.S. Cl. ..... 347/54

(58) Field of Classification Search ..... 347/54, 347/68, 69, 70, 71, 72, 50, 40, 20, 44, 47, 347/27; 399/261; 361/700; 29/890.1; 310/328–330
See application file for complete search history.

(56) References Cited

U.S. PATENT DOCUMENTS 1,941,001 A * 12/1933 Hansell
3,373,437 A * 3/1968 Sweet et al.
3,596,275 A * 7/1971 Sweet
3,683,212 A * 8/1972 Zolten
3,747,120 A * 7/1973 Stemme
3,946,398 A * 3/1976 Kyser et al.
4,459,601 A * 7/1984 Howkins
4,490,728 A * 12/1984 Vaught et al.
4,584,590 A * 4/1986 Fischbeck et al.
4,728,392 A 3/1988 Miura et al.
5,598,200 A 1/1997 Gore
5,812,159 A 9/1998 Anagnostopoulos et al.
5,828,394 A 10/1998 Khuri-Yakub et al.
5,872,582 A 2/1999 Pan
5,929,877 A 7/1999 Hetzer et al.
5,970,998 A 10/1999 Talbot et al.
6,087,638 A * 7/2000 Silverbrook
6,120,124 A * 9/2000 Atobe et al.
6,171,875 B1 * 1/2001 Silverbrook
6,180,427 B1 * 1/2001 Silverbrook
6,217,183 B1 * 4/2001 Silverbrook
6,220,694 B1 * 4/2001 Silverbrook
6,238,040 B1 * 5/2001 Silverbrook
6,239,821 B1 * 5/2001 Silverbrook
6,243,113 B1 * 6/2001 Silverbrook
6,244,691 B1 * 6/2001 Silverbrook
6,245,247 B1 * 6/2001 Silverbrook
6,247,790 B1 * 6/2001 Silverbrook
6,247,791 B1 * 6/2001 Silverbrook
6,247,792 B1 * 6/2001 Silverbrook
6,247,795 B1 * 6/2001 Silverbrook
6,247,796 B1 * 6/2001 Silverbrook
6,477,794 B1 * 6/2001 Silverbrook

* cited by examiner

*Primary Examiner*—Raquel Yvette Gordon

(57) ABSTRACT

An ink jet nozzle assembly for an ink jet printer includes a nozzle chamber having an ink inlet communicating with an ink reservoir and a nozzle through which ink from the chamber can be ejected onto a page. The chamber includes a fixed portion and a movable portion configured for relative movement in an ejection phase and alternate relative movement in a refill phase. The movable portion includes a number of thermal actuator petal devices arranged around a central stem. The petal devices undergo bending upon heating to effect periodically the relative movement. The inlet is positioned and dimensioned relative to the nozzle such that ink is ejected preferentially from the chamber through the nozzle in droplet form during the ejection phase, and ink is alternately drawn preferentially into the chamber from the reservoir through the inlet during the refill phase.

18 Claims, 35 Drawing Sheets

INK JET WITH THIN NOZZLE WALL

This is a C-I-P of application Ser. No. 09/113,095 filed on Jul. 10, 1998.

FIELD OF THE INVENTION

The present invention relates to ink jet printing and in particular discloses a curling calyx thermoelastic ink jet printer.

The present invention further relates to the field of drop on demand ink jet printing.

BACKGROUND OF THE INVENTION

Many different types of printing have been invented, a large number of which are presently in use. The known forms of print have a variety of methods for marking the print media with a relevant marking media. Commonly used forms of printing include offset printing, laser printing and copying devices, dot matrix type impact printers, thermal paper printers, film recorders, thermal wax printers, dye sublimation printers and ink jet printers both of the drop on demand and continuous flow type. Each type of printer has its own advantages and problems when considering cost, speed, quality, reliability, simplicity of construction and operation etc.

In recent years, the field of ink jet printing, wherein each individual pixel of ink is derived from one or more ink nozzles has become increasingly popular primarily due to its inexpensive and versatile nature.

Many different techniques on ink jet printing have been invented. For a survey of the field, reference is made to an article by J Moore, "Non-Impact Printing: Introduction and Historical Perspective", Output Hard Copy Devices, Editors R Dubeck and S Sherr, pages 207–220 (1988).

Ink Jet printers themselves come in many different types. The utilisation of a continuous stream ink in ink jet printing appears to date back to at least 1929 wherein U.S. Pat. No. 1,941,001 by Hansell discloses a simple form of continuous stream electro-static ink jet printing.

U.S. Pat. No. 3,596,275 by Sweet also discloses a process of a continuous ink jet printing including the step wherein the ink jet stream is modulated by a high frequency electro-static field so as to cause drop separation. This technique is still used by several manufacturers including Elmjet and Scitex (see also U.S. Pat. No. 3,373,437 by Sweet et al)

Piezoelectric ink jet printers are also one form of commonly utilized ink jet printing device. Piezoelectric systems are disclosed by Kyser et. al. in U.S. Pat. No. 3,946,398 (1970) which utilizes a diaphragm mode of operation, by Zolten in U.S. Pat. No. 3,683,212 (1970) which discloses a squeeze mode of operation of a piezoelectric crystal, Stemme in U.S. Pat. No. 3,747,120 (1972) discloses a bend mode of piezoelectric operation, Howkins in U.S. Pat. No. 4,459,601 discloses a piezoelectric push mode actuation of the ink jet stream and Fischbeck in U.S. Pat. No. 4,584,590 which discloses a shear mode type of piezoelectric transducer element.

Recently, thermal ink jet printing has become an extremely popular form of ink jet printing. The ink jet printing techniques include those disclosed by Endo et al in GB 2007162 (1979) and Vaught et al in U.S. Pat. No. 4,490,728. Both the aforementioned references disclosed ink jet printing techniques rely upon the activation of an electrothermal actuator which results in the creation of a bubble in a constricted space, such as a nozzle, which thereby causes the ejection of ink from an aperture connected to the confined space onto a relevant print media. Printing devices utilizing the electro-thermal actuator are manufactured by manufacturers such as Canon and Hewlett Packard.

As can be seen from the foregoing, many different types of printing technologies are available. Ideally, a printing technology should have a number of desirable attributes. These include inexpensive construction and operation, high speed operation, safe and continuous long term operation etc. Each technology may have its own advantages and disadvantages in the areas of cost, speed, quality, reliability, power usage, simplicity of construction operation, durability and consumables.

SUMMARY OF THE INVENTION

It is an object of the present invention to provide an alternative form of ink jet printer and in particular an alternative form of nozzle construction for the ejection of ink from a nozzle port.

There is disclosed herein an ink jet nozzle assembly including a nozzle chamber formed upon a substrate, the nozzle chamber having a wall having a nozzle formed therein, the wall being less than about 5 μm thick.

Preferably the wall is less than about 2 μm thick.

Preferably the assembly is manufactured using micro-electro-mechanical system (MEMS) techniques.

The present invention further provides an ink jet nozzle assembly including:

- a nozzle chamber having an inlet in fluid communication with an ink reservoir and a nozzle through which ink from the chamber can be ejected;
- the chamber including a fixed portion and a movable portion configured for relative movement in an ejection phase and alternate relative movement in a refill phase;
- the movable portion including a plurality of thermal actuator petal devices arranged around a central stem, said petal devices undergoing bending upon heating to effect periodically said relative movement; and
- the inlet being positioned and dimensioned relative to the nozzle such that ink is ejected preferentially from the chamber through the nozzle in droplet form during the ejection phase, and ink is alternately drawn preferentially into the chamber from the reservoir through the inlet during the refill phase.

Preferably the movable portion includes the nozzle and the fixed portion is mounted on a substrate.

Preferably the fixed portion includes the nozzle mounted on a substrate and the movable portion includes the petal devices.

Preferably said petal devices bend generally toward said ink ejection port.

Preferably said petal devices comprise a first material having a high coefficient of thermal expansion surrounding a second material which conducts resistively so as to provide for heating of said first material.

Preferably said second material is constructed so as to concertina upon expansion of said first material.

Preferably a surface of said petal devices which is to bend in a convex form is hydrophobic.

Preferably a surface of said petal device which is to bend in a concave form is hydrophilic.

Preferably, during operation, an air bubble forms under said petal devices.

Preferably said first material comprises substantially polytetrafluoroethylene.

Preferably said second material comprises substantially copper.

Preferably a space between adjacent petal devices is reduced upon said bending upon heating.

Preferably the petal devices are attached to a substrate and heating of said petal devices is primarily near an attached end of each said petal device.

Preferably an outer surface of said ink chamber includes a plurality of etchant holes provided so as to allow rapid etching of a sacrificial layer during construction.

Preferably the assembly is manufactured using micro-electro-mechanical systems (MEMS) techniques.

BRIEF DESCRIPTION OF THE DRAWINGS

Notwithstanding any other forms which may fall within the scope of the present invention, preferred forms of the invention will now be described, by way of example only, with reference to the accompanying drawings, which.

DESCRIPTION OF PREFERRED AND OTHER EMBODIMENTS

In the preferred embodiment, an ink jet printhead is constructed from an array of ink nozzle chambers which utilize a thermal actuator for the ejection of ink having a shape reminiscent of the calyx arrangement of a flower. The thermal actuator is activated so as to close the flower arrangement and thereby cause the ejection of ink from a nozzle chamber formed in the space above the calyx arrangement. The calyx arrangement has particular advantages in allowing for rapid refill of the nozzle chamber in addition to efficient operation of the thermal actuator.

Figure 1:
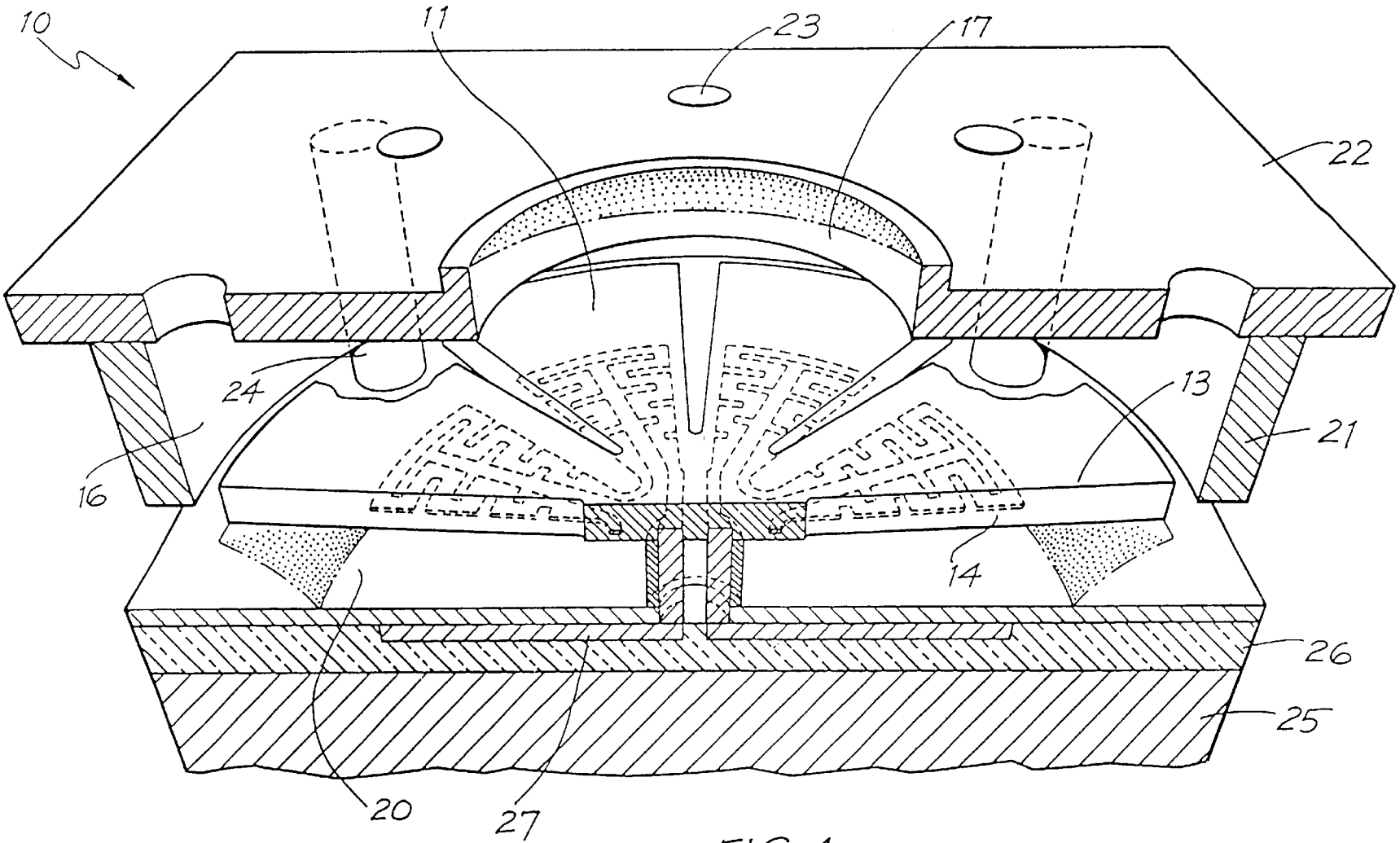
FIG. 1 is a cross-sectional perspective view of a single ink nozzle arrangement constructed in accordance with the preferred embodiment, with the actuator in its quiescent state.

Turning to FIG. 1, there is shown a perspective—sectional view of a single nozzle chamber of a printhead 10 as constructed in accordance with the preferred embodiment. The printhead arrangement 10 is based around a calyx type structure 11 which includes a plurality of petals eg. 13 which are constructed from polytetrafluoroethylene (PTFE). The petals 13 include an internal resistive element 14 which can comprise a copper heater. The resistive element 14 is generally of a serpentine structure, such that, upon heating, the resistive element 14 can concertina and thereby expand at the rate of expansion of the PTFE petals, e.g. 13. The PTFE petal 13 has a much higher coefficient thermal expansion ($770\times10^{6}$) and therefore undergoes substantial expansion upon heating. The resistive elements 14 are constructed nearer to the lower surface of the PTFE petal 13 and as a result, the bottom surface of PTFE petal 13 is heated more rapidly than the top surface. The difference in thermal grading results in a bending upwards of the petals 13 upon heating. Each petal eg. 13 is heated together which results in a combined upward movement of all the petals at the same time which in turn results in the imparting of momentum to the ink within chamber 16 such that ink is forced out of the ink nozzle 17. The forcing out of ink out of ink nozzle 17 results in an expansion of the meniscus 18 and subsequently results in the ejection of drops of ink from the nozzle 17.

Figure 2:
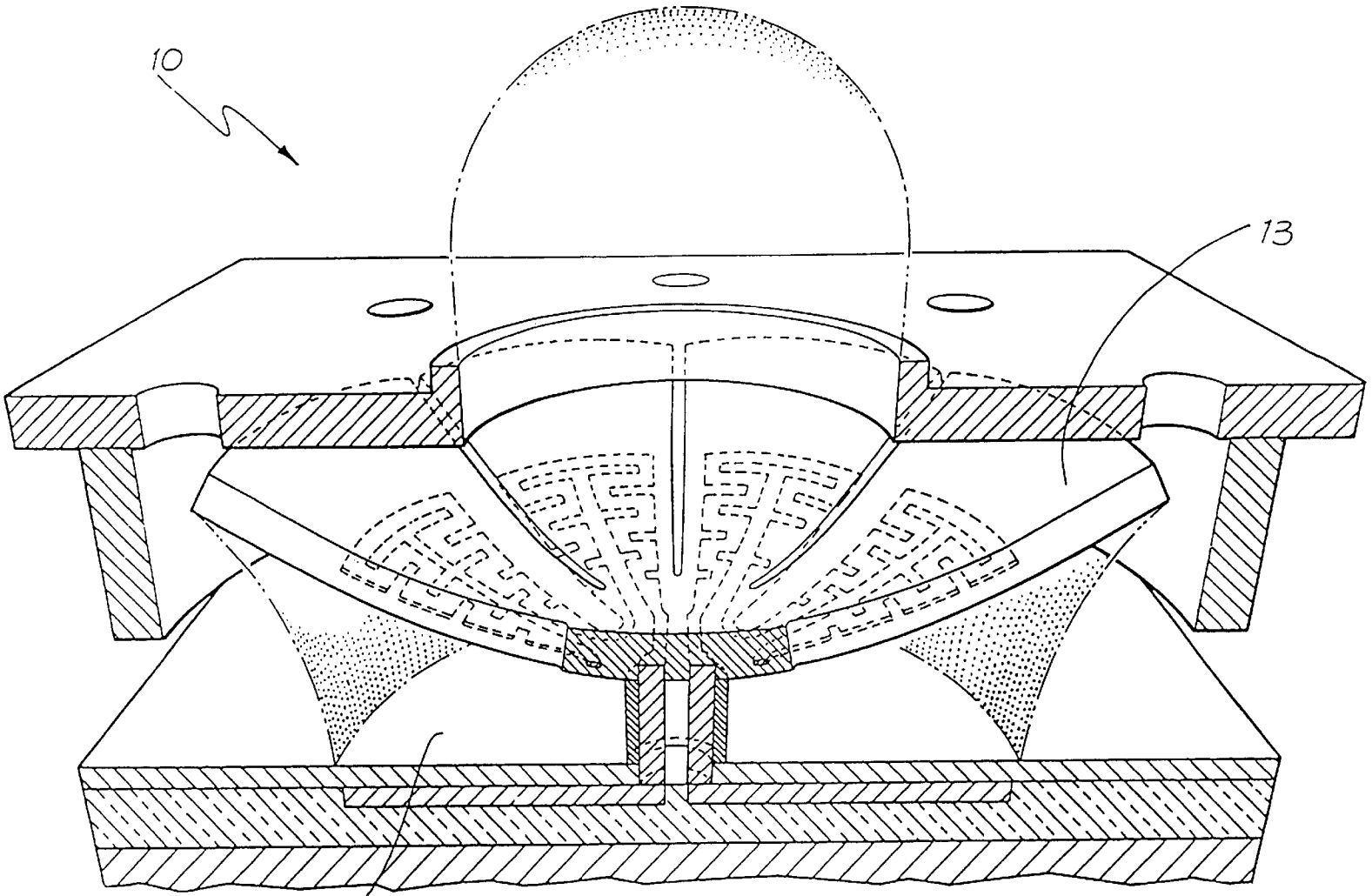
FIG. 2 is a cross-sectional perspective view of a single ink nozzle arrangement constructed in accordance with the preferred embodiment, in its activated state.

An important advantageous feature of the preferred embodiment is that PTFE is normally hydrophobic. In the preferred embodiment the bottom surface of petals 13 comprises untreated PTFE and is therefore hydrophobic. This results in an air bubble 20 forming under the surface of the petals. The air bubble contracts on upward movement of petals 13 as illustrated in FIG. 2 which illustrates a cross-sectional perspective view of the form of the nozzle after activation of the petal heater arrangement.

The top of the petals is treated so as to reduce its hydrophobic nature. This can take many forms, including plasma damaging in an ammonia atmosphere. The top of the petals 13 is treated so as to generally make it hydrophilic and thereby attract ink into nozzle chamber 16.

Returning now to FIG.1, the nozzle chamber 16 is constructed from a circular rim 21 of an inert material such as nitride as is the top nozzle plate 22. The top nozzle plate 22 can include a series of the small etchant holes 23 which are provided to allow for the rapid etching of sacrificial material used in the construction of the nozzle chamber 10. The etchant holes 23 are large enough to allow the flow of etchant into the nozzle chamber 16 however, they are small enough so that surface tension effects retain any ink within the nozzle chamber 16. A series of posts 24 are further provided for support of the nozzle plate 22 on a wafer 25.

The wafer 25 can comprise a standard silicon wafer on top of which is constructed data drive circuitry which can be constructed in the usual manner such as two level metal CMOS with portions one level of metal (aluminium) being used 26 for providing interconnection with the copper circuitry portions 27.

The arrangement 10 of FIG. 1 has a number of significant advantages in that, in the petal open position, the nozzle chamber 16 can experience rapid refill, especially where a slight positive ink pressure is utilized. Further, the petal arrangement provides a degree of fault tolerance in that, if one or more of the petals is non-functional, the remaining petals can operate so as to eject drops of ink on demand.

Figure 3:
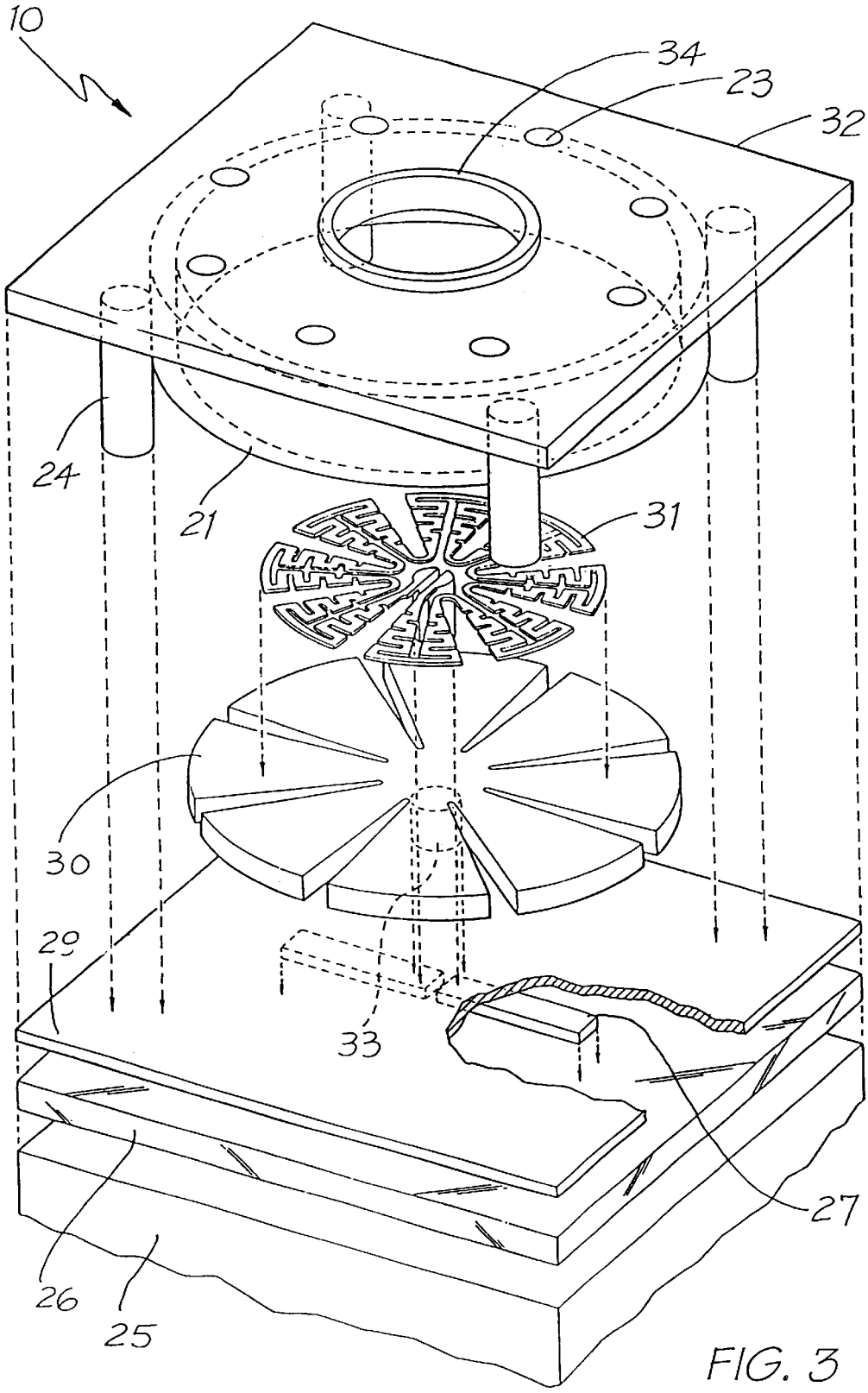
FIG. 3 is an exploded perspective view illustrating the construction of a single ink nozzle in accordance with the preferred embodiment of the present invention.

Turning now to FIG. 3, there is illustrated an exploded perspective of the various layers of a nozzle arrangement 10. The nozzle arrangement 10 is constructed on a base wafer 25 which can comprise a silicon wafer suitably diced in accordance with requirements. On the silicon wafer 25 is constructed a silicon glass layer which can include the usual CMOS processing steps to construct a two level metal CMOS drive and control circuitry layer. Part of this layer will include portions 27 which are provided for interconnection with the drive transistors. On top of the CMOS layer 26, 27 is constructed a nitride passivation layer 29 which provides passivation protection for the lower layers during operation and also should an etchant be utilized which would normally dissolve the lower layers. The PTFE layer 30 really comprises a bottom PTFE layer below a copper metal layer 31 and a top PTFE layer above it, however, they are shown as one layer in FIG. 3. Effectively, the copper layer 31 is encased in the PTFE layer 30 as a result. Finally, a nitride layer 32 is provided so as to form the rim 21 of the nozzle chamber and nozzle posts 24 in addition to the nozzle plate.

The arrangement 10 can be constructed on a silicon wafer using micro-electro-mechanical systems techniques. For a general introduction to a micro-electro mechanical system (MEMS) reference is made to standard proceedings in this field including the proceedings of the SPIE (International Society for Optical Engineering), volumes 2642 and 2882 which contain the proceedings for recent advances and conferences in this field. The PTFE layer 30 can be constructed on a sacrificial material base such as glass, wherein a via for stem 33 of layer 30 is provided.

The layer 32 is constructed on a second sacrificial etchant material base so as to form the nitride layer 32. The sacrificial material is then etched away using a suitable etchant which does not attack the other material layers so as to release the internal calyx structure. To this end, the nozzle plate 32 includes the aforementioned etchant holes eg. 23 so as to speed up the etching process, in addition to the nozzle 17 and the nozzle rim 34.

The nozzles 10 can be formed on a wafer of printheads as required. Further, the printheads can include supply means either in the form of a "through the wafer" ink supply means which uses high density low pressure plasma etching such as that available from Surface Technology Systems or via means of side ink channels attached to the side of the printhead. Further, areas can be provided for the interconnection of circuitry to the wafer in the normal fashion as is normally utilized with MEMS processes.

Figure 4:
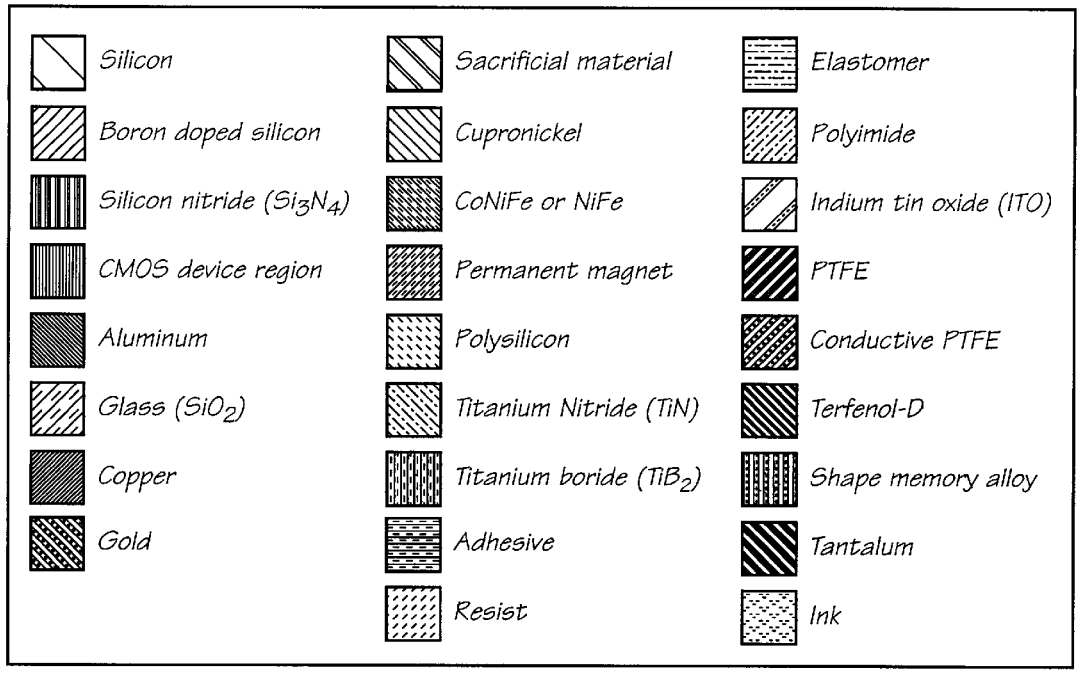
FIG. 4 provides a legend of the materials indicated in FIG. 5 to 18.
Figure 5:
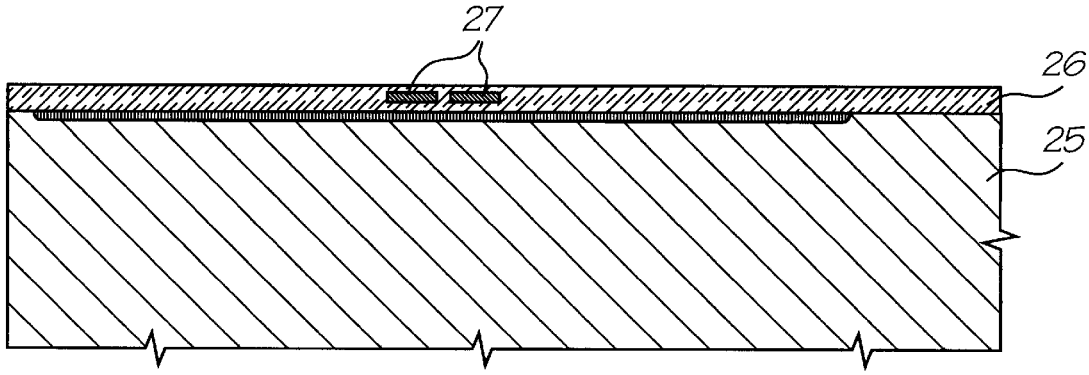
FIG. 5 to FIG. 18 illustrate sectional views of the manufacturing steps in one form of construction of an ink jet printhead nozzle.

One form of detailed manufacturing process which can be used to fabricate monolithic ink jet printheads operating in accordance with the principles taught by the present embodiment can proceed utilizing the following steps:

1. Using a double sided polished wafer, Complete drive transistors, data distribution, and timing circuits using a 0.5 micron, one poly, 2 metal CMOS process. This step is shown in FIG. 5. For clarity, these diagrams may not be to scale, and may not represent a cross section though any single plane of the nozzle. FIG. 4 is a key to representations of various materials in these manufacturing diagrams, and those of other cross referenced ink jet configurations.

Figure 6:
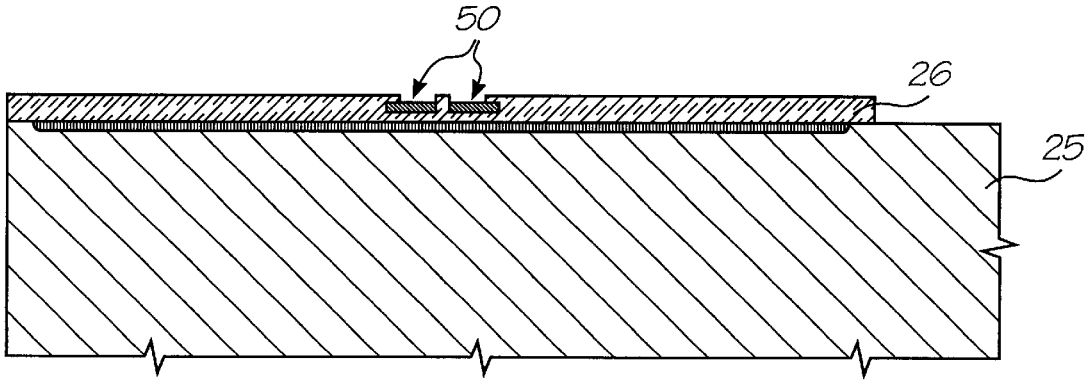

2. Etch through the silicon dioxide layers of the CMOS process down to silicon using mask 1. This mask defines the ink inlet channels and the heater contact vias. This step is shown in FIG. 6.

Figure 7:
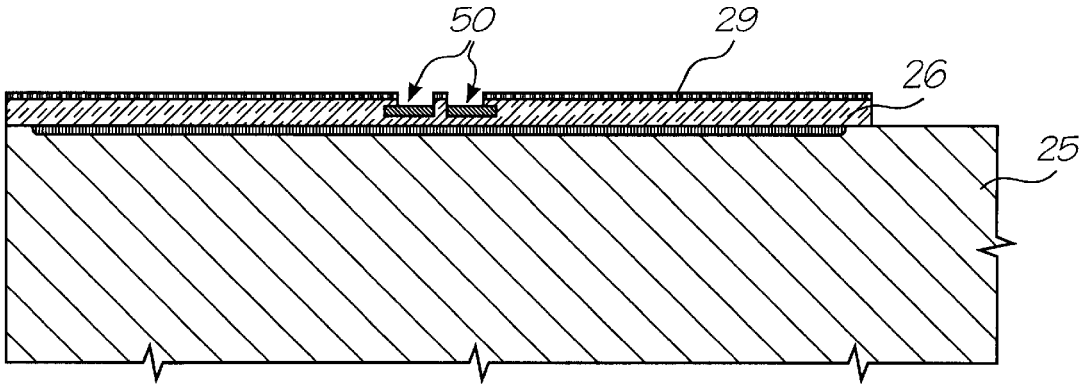

3. Deposit 1 micron of low stress nitride. This acts as a barrier to prevent ink diffusion through the silicon dioxide of the chip surface. This step is shown in FIG. 7.

4. Deposit 3 micron of sacrificial material (e.g. photosensitive polyimide)

Figure 8:
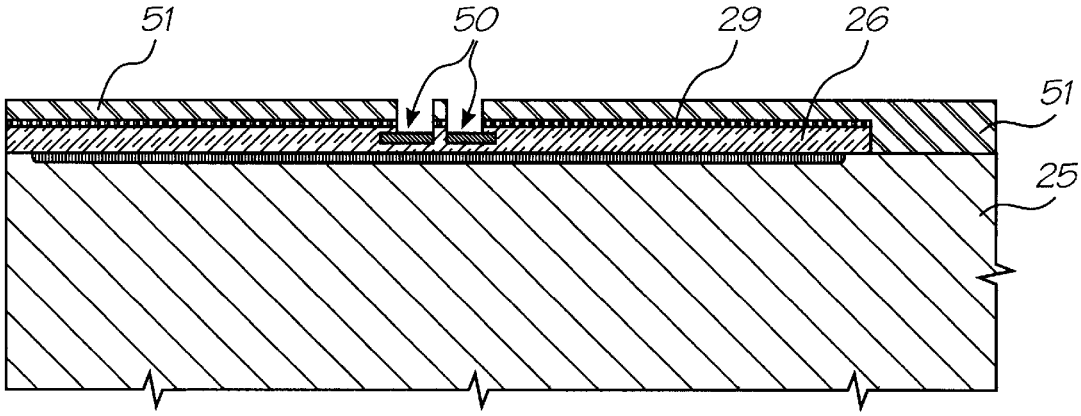

5. Etch the sacrificial layer using mask 2. This mask defines the actuator anchor point. This step is shown in FIG. 8.

6. Deposit 0.5 micron of PTFE.

Figure 9:
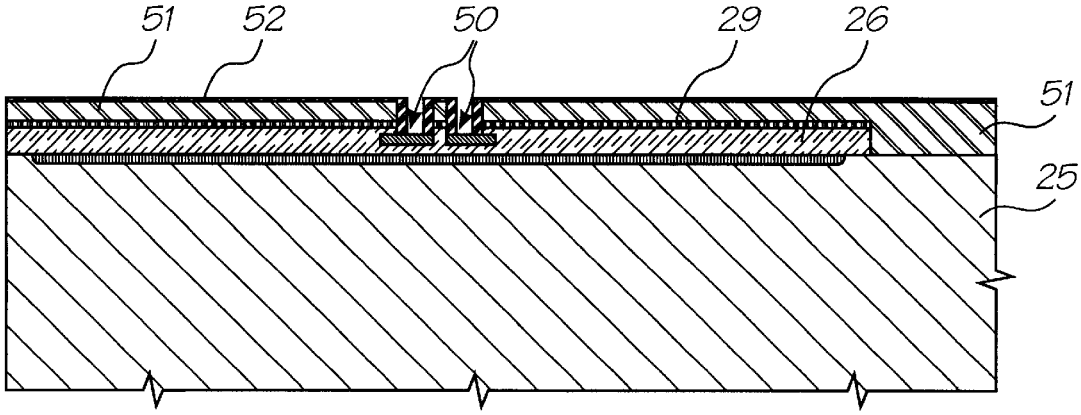

7. Etch the PTFE, nitride, and oxide down to second level metal using mask 3. This mask defines the heater vias. This step is shown in FIG. 9.

8. Deposit 0.5 micron of heater material with a low Young's modulus, for example aluminum or gold.

Figure 10:
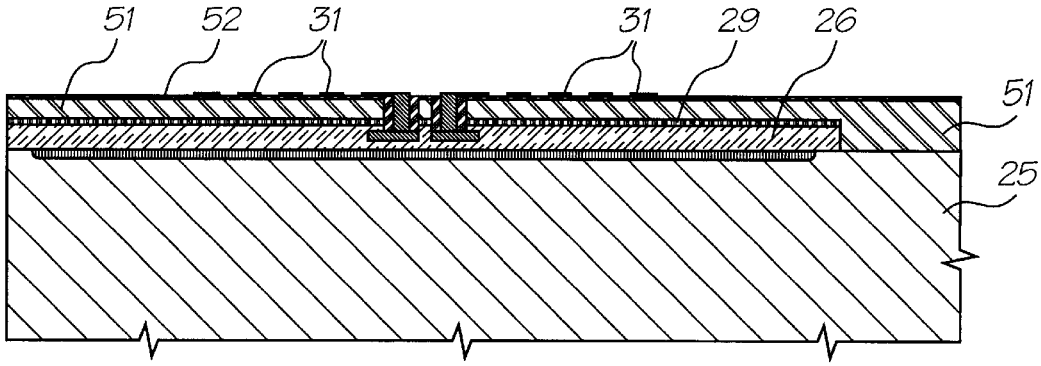

9. Pattern the heater using mask 4. This step is shown in FIG. 10.

10. Wafer probe. All electrical connections are complete at this point, and the chips are not yet separated.

11. Deposit 1.5 microns of PTFE.

Figure 11:
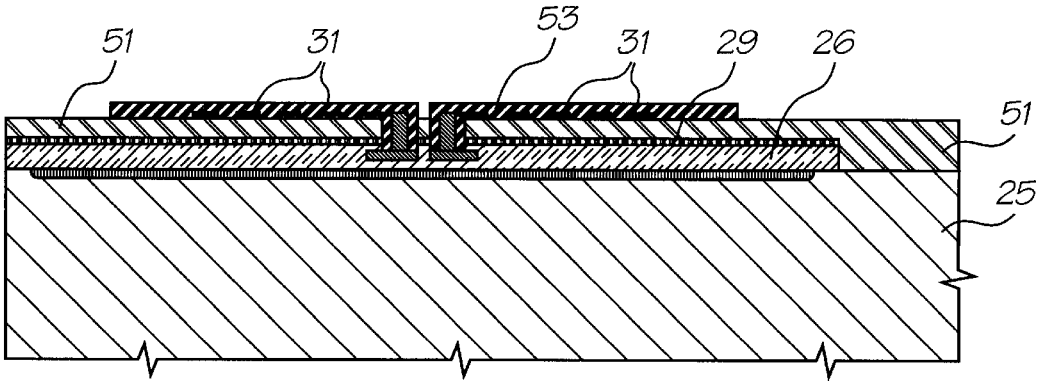

12. Etch the PTFE down to the sacrificial layer using mask 5. This mask defines the actuator petals. This step is shown in FIG. 11.

13. Plasma process the PTFE to make the top surface hydrophilic.

14. Deposit 6 microns of sacrificial material.

15. Etch the sacrificial material to a depth of 5 microns using mask 6. This mask defines the suspended walls of the nozzle chamber, the nozzle plate suspension posts, and the walls surrounding each ink color (not shown).

Figure 12:
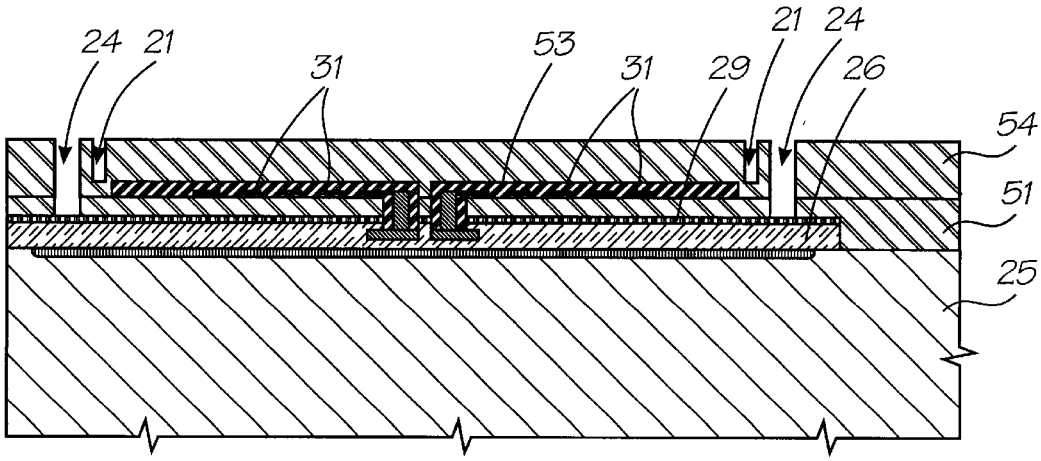

16. Etch the sacrificial material down to nitride using mask 7. This mask defines the nozzle plate suspension posts and the walls surrounding each ink color (not shown). This step is shown in FIG. 12.

Figure 13:
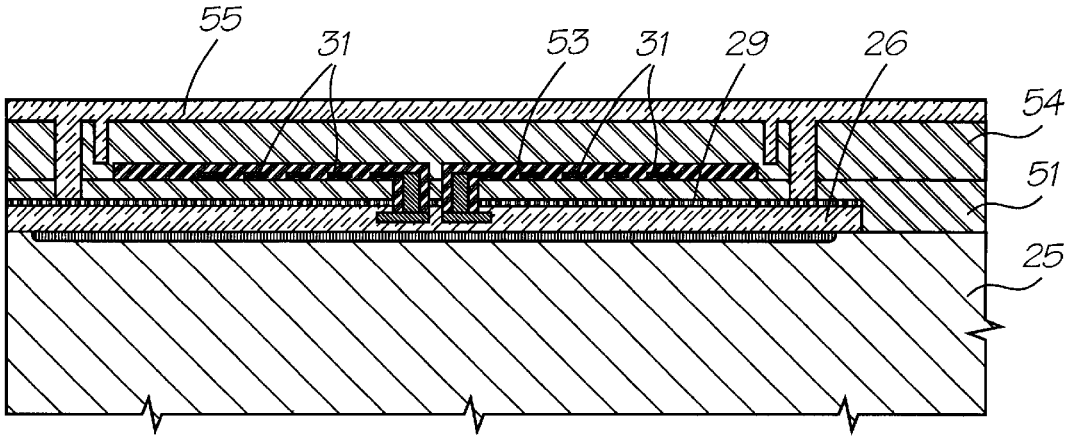

17. Deposit 3 microns of PECVD glass. This step is shown in FIG. 13.

Figure 14:
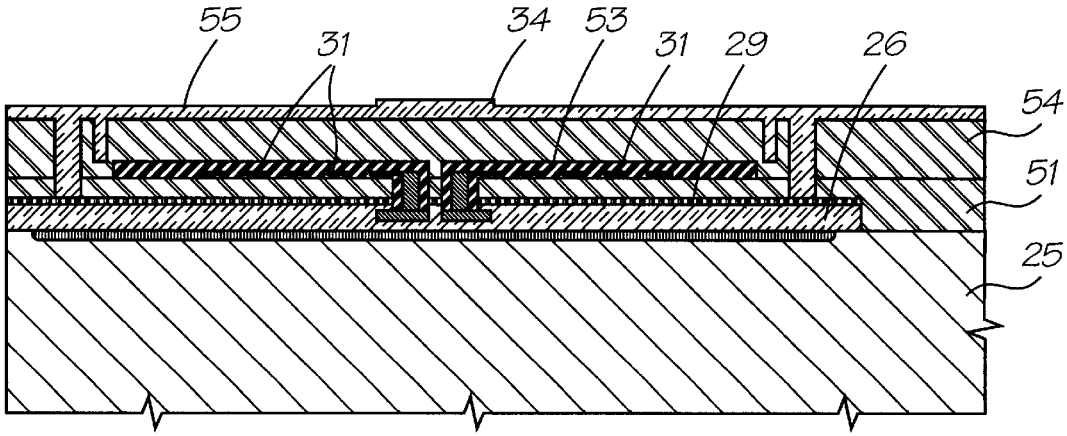

18. Etch to a depth of 1 micron using mask 8. This mask defines the nozzle rim. This step is shown in FIG. 14.

Figure 15:
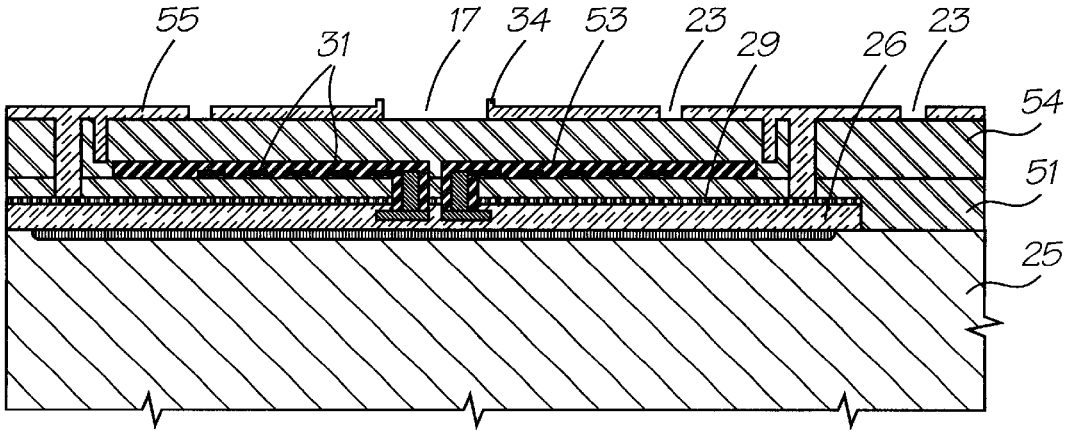

19. Etch down to the sacrificial layer using mask 9. This mask defines the nozzle and the sacrificial etch access holes. This step is shown in FIG. 15.

Figure 16:
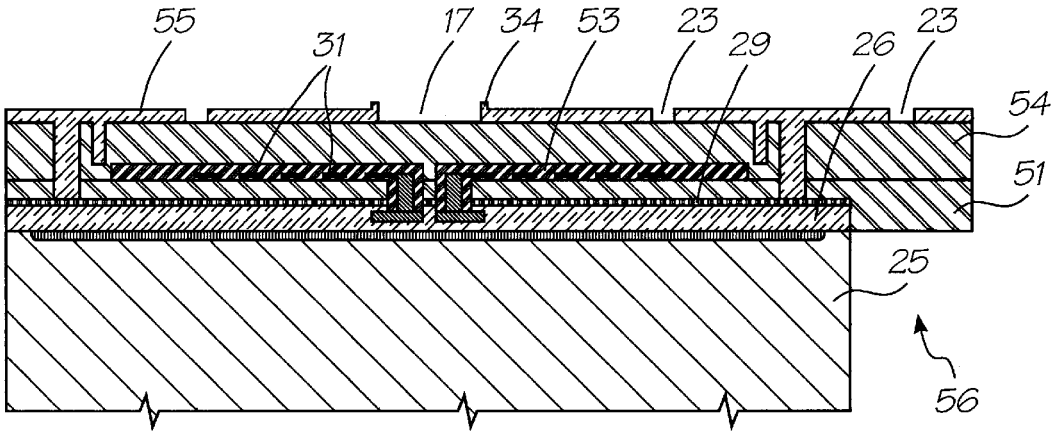

20. Back-etch completely through the silicon wafer (with, for example, an ASE Advanced Silicon Etcher from Surface Technology Systems) using mask 10. This mask defines the ink inlets which are etched through the wafer. The wafer is also diced by this etch. This step is shown in FIG. 16.

Figure 17:
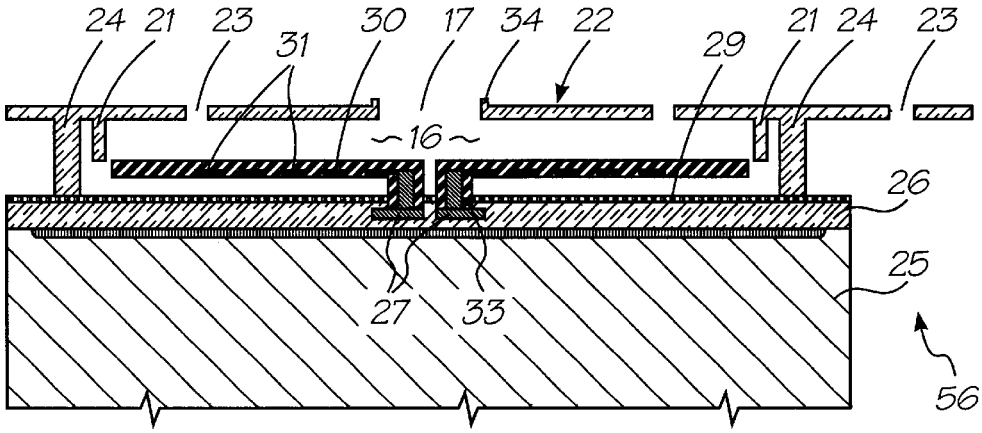

21. Etch the sacrificial material. The nozzle chambers are cleared, the actuators freed, and the chips are separated by this etch. This step is shown in FIG. 17.

22. Mount the printheads in their packaging, which may be a molded plastic former incorporating ink channels which supply the appropriate color ink to the ink inlets at the back of the wafer.

23. Connect the printheads to their interconnect systems. For a low profile connection with minimum disruption of airflow, TAB may be used. Wire bonding may also be used if the printer is to be operated with sufficient clearance to the paper.

24. Hydrophobize the front surface of the printheads.

Figure 18:
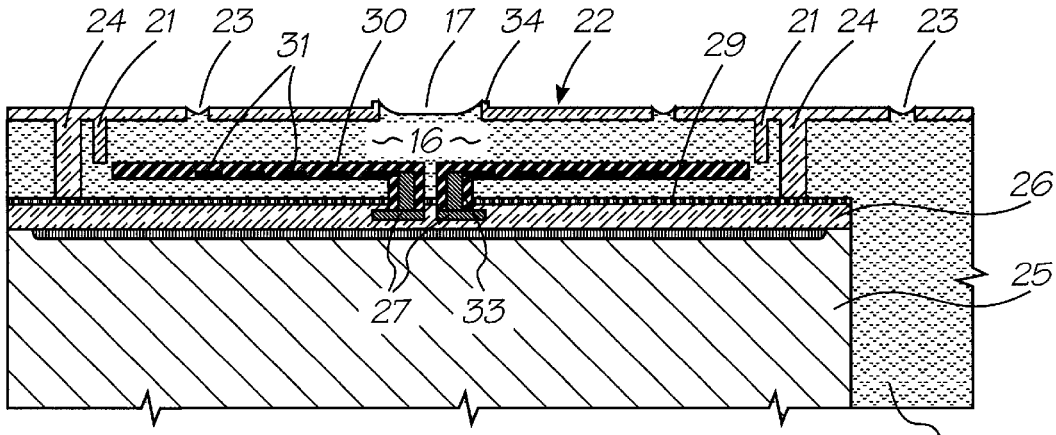

25. Fill the completed printheads with ink and test them. A filled nozzle is shown in FIG. 18.

Figure 19:
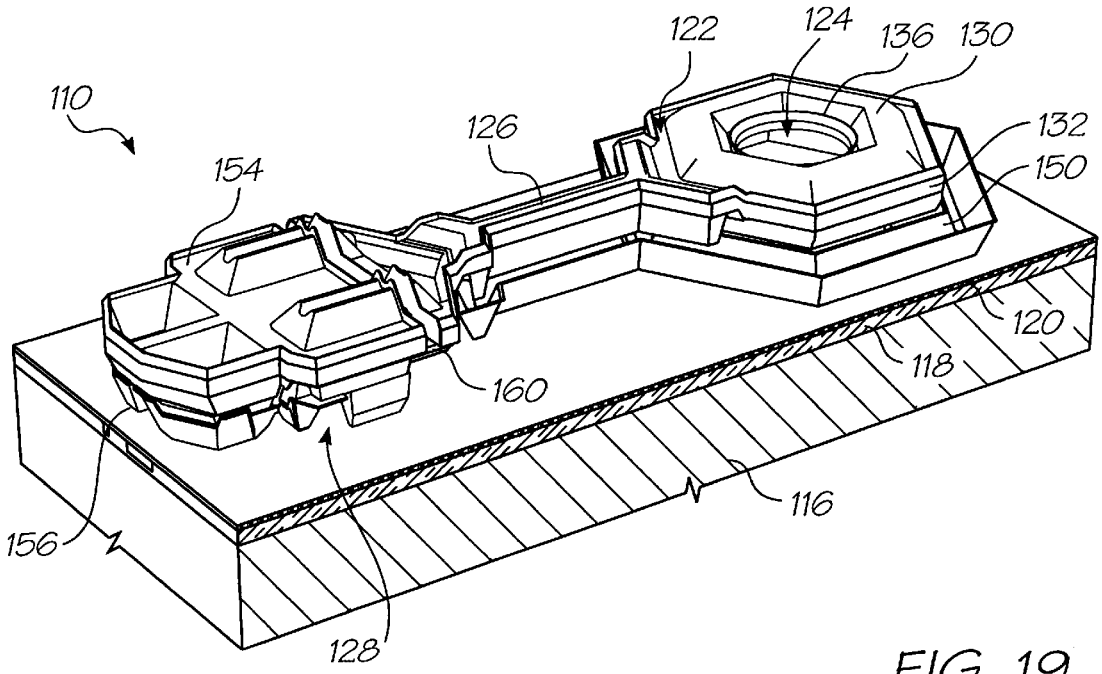
FIG. 19 shows a three dimensional, schematic view of a nozzle assembly for an ink jet printhead in accordance with another embodiment of the invention.

Referring now to FIG. 19 of the drawings, a nozzle assembly, in accordance with a further embodiment of the invention is designated generally by the reference numeral 110. An ink jet printhead has a plurality of nozzle assemblies 110 arranged in an array 114 (FIGS. 23 and 24) on a silicon substrate 116. The array 114 will be described in greater detail below.

The assembly 110 includes a silicon substrate or wafer 116 on which a dielectric layer 118 is deposited. A CMOS passivation layer 120 is deposited on the dielectric layer 118.

Each nozzle assembly 110 includes a nozzle 122 defining a nozzle opening 124, a connecting member in the form of a lever arm 126 and an actuator 128. The lever arm 126 connects the actuator 128 to the nozzle 122.

Figure 20:
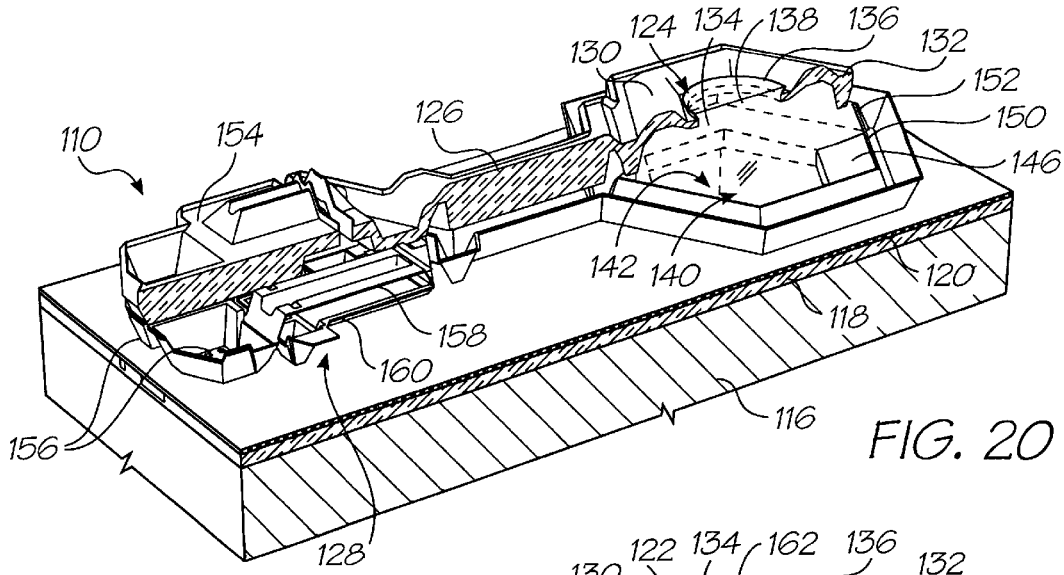
FIGS. 20 to 22 show a three dimensional, schematic illustration of an operation of the nozzle assembly of FIG. 19.
Figure 21:
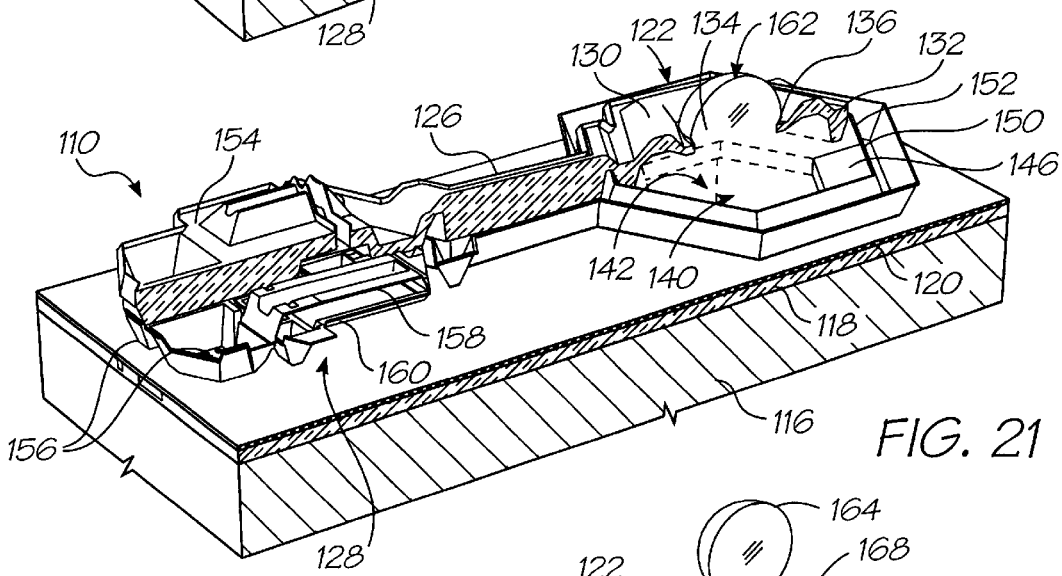
Figure 22:
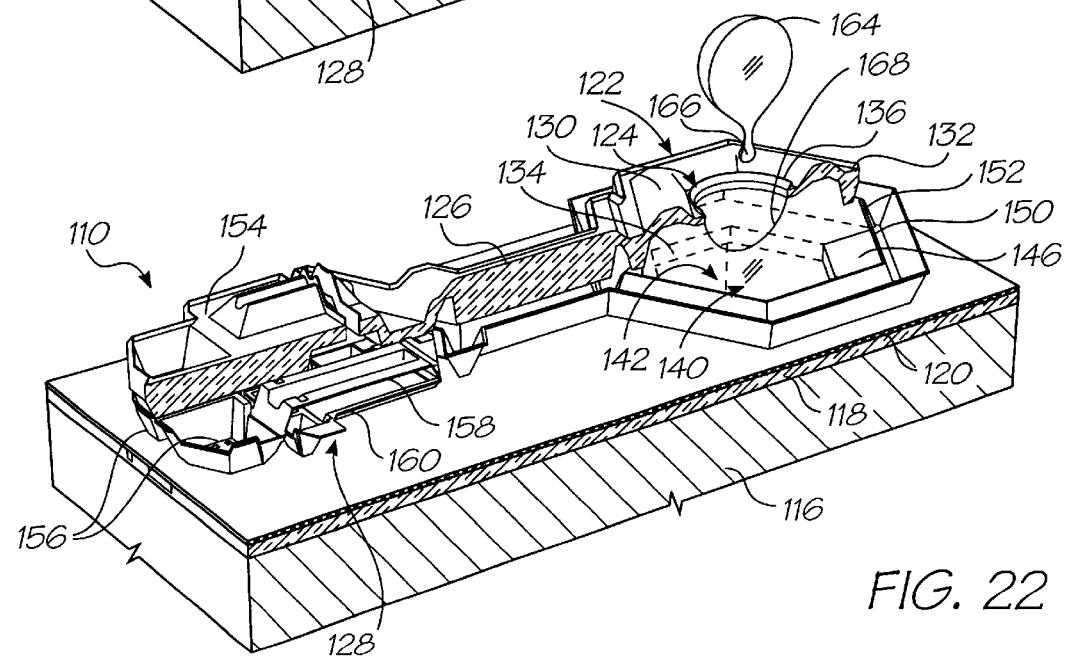

As shown in greater detail in FIGS. 20 to 22 of the drawings, the nozzle 122 comprises a crown portion 130 with a skirt portion 132 depending from the crown portion 130. The skirt portion 132 forms part of a peripheral wall of a nozzle chamber 134 (FIGS. 20 to 22 of the drawings). The nozzle opening 124 is in fluid communication with the nozzle chamber 134. It is to be noted that the nozzle opening 124 is surrounded by a raised rim 136 which "pins" a meniscus 138 (FIG. 20) of a body of ink 140 in the nozzle chamber 134.

An ink inlet aperture 142 (shown most clearly in FIG. 24) is defined in a floor 146 of the nozzle chamber 134. The aperture 142 is in fluid communication with an ink inlet channel 148 defined through the substrate 116.

A wall portion 150 bounds the aperture 142 and extends upwardly from the floor portion 146. The skirt portion 132, as indicated above, of the nozzle 122 defines a first part of a peripheral wall of the nozzle chamber 134 and the wall portion 150 defines a second part of the peripheral wall of the nozzle chamber 134.

The wall 150 has an inwardly directed lip 152 at its free end which serves as a fluidic seal which inhibits the escape of ink when the nozzle 122 is displaced, as will be described in greater detail below. It will be appreciated that, due to the viscosity of the ink 140 and the small dimensions of the spacing between the lip 152 and the skirt portion 132, the inwardly directed lip 152 and surface tension function as a seal for inhibiting the escape of ink from the nozzle chamber 134.

The actuator 128 is a thermal bend actuator and is connected to an anchor 154 extending upwardly from the substrate 116 or, more particularly, from the CMOS passivation layer 120. The anchor 154 is mounted on conductive pads 156 which form an electrical connection with the actuator 128.

The actuator 128 comprises a first, active beam 158 arranged above a second, passive beam 160. In a preferred embodiment, both beams 158 and 160 are of, or include, a conductive ceramic material such as titanium nitride (TiN).

Both beams 158 and 160 have their first ends anchored to the anchor 154 and their opposed ends connected to the arm 126. When a current is caused to flow through the active beam 158 thermal expansion of the beam 158 results. As the passive beam 160, through which there is no current flow, does not expand at the same rate, a bending moment is created causing the arm 126 and, hence, the nozzle 122 to be displaced downwardly towards the substrate 116 as shown in FIG. 21 of the drawings. This causes an ejection of ink through the nozzle opening 124 as shown at 162 in FIG. 21 of the drawings. When the source of heat is removed from the active beam 158, i.e. by stopping current flow, the nozzle 122 returns to its quiescent position as shown in FIG. 22 of the drawings. When the nozzle 122 returns to its quiescent position, an ink droplet 164 is formed as a result of the breaking of an ink droplet neck as illustrated at 166 in FIG. 22 of the drawings. The ink droplet 164 then travels on to the print media such as a sheet of paper. As a result of the formation of the ink droplet 164, a "negative" meniscus is formed as shown at 168 in FIG. 22 of the drawings. This "negative" meniscus 168 results in an inflow of ink 140 into the nozzle chamber 134 such that a new meniscus 138 (FIG. 20) is formed in readiness for the next ink drop ejection from the nozzle assembly 110.

Figure 23:
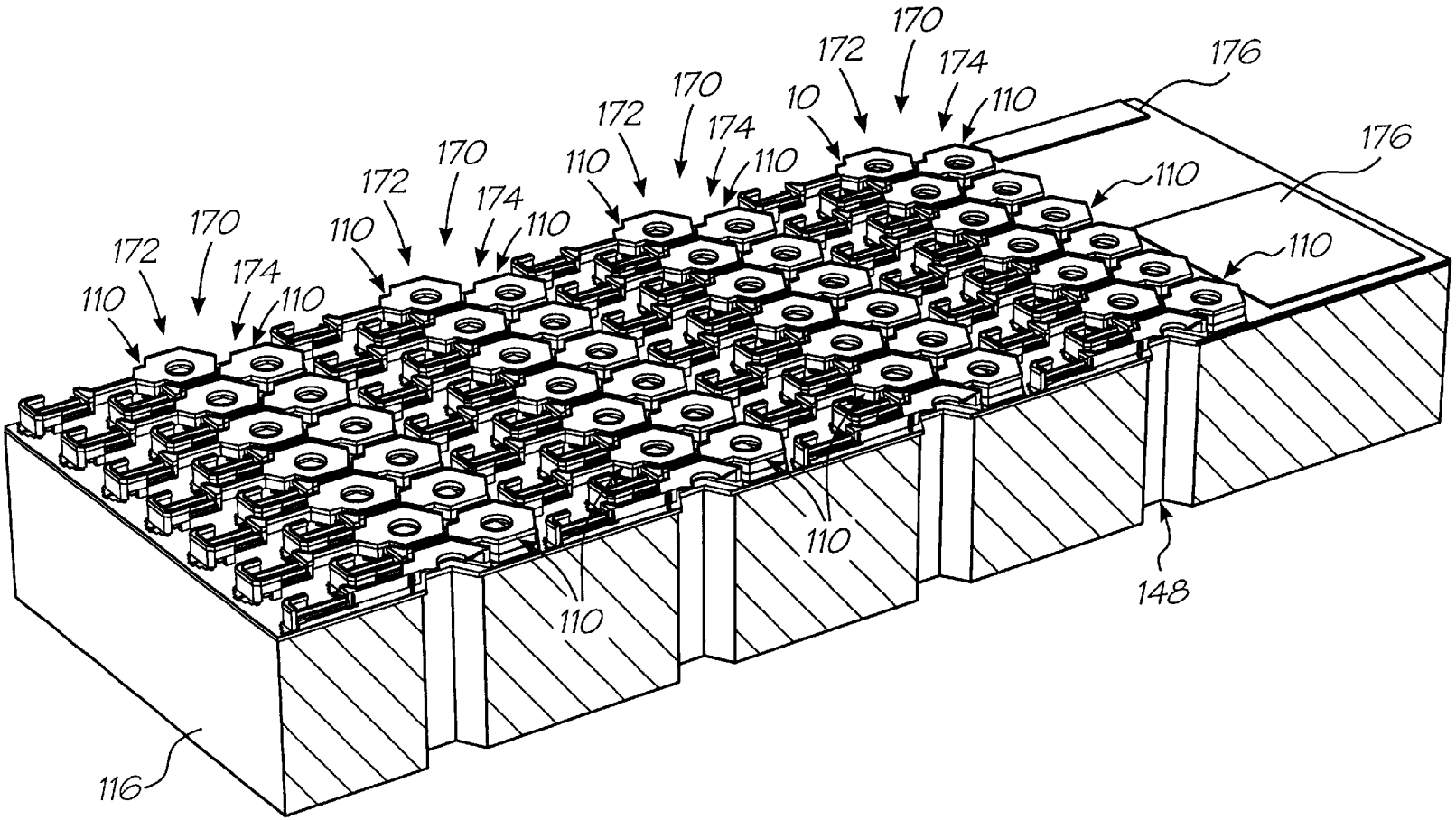
FIG. 23 shows a three dimensional view of a nozzle array constituting an ink jet printhead.
Figure 24:
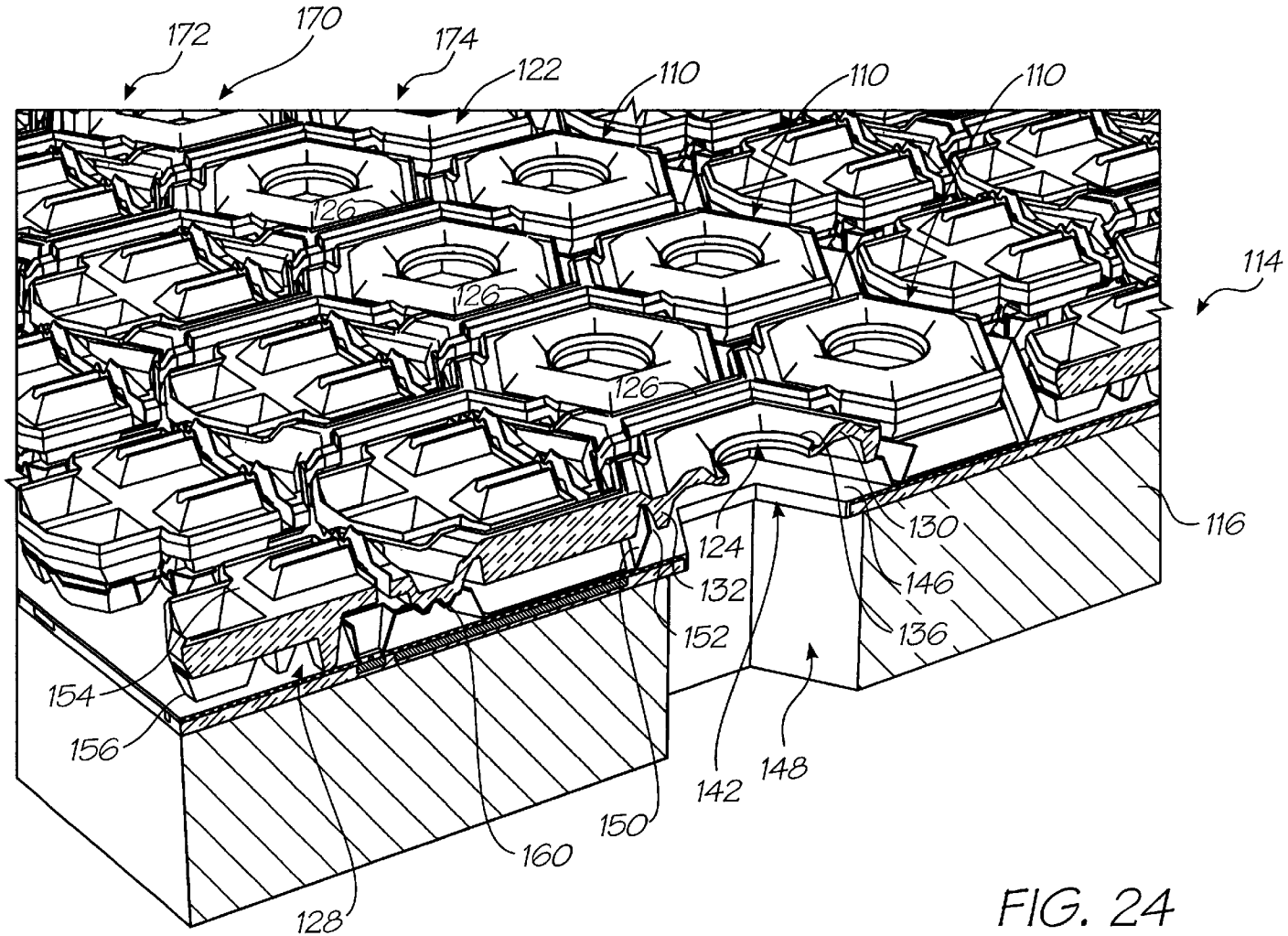
FIG. 24 shows, on an enlarged scale, part of the array of FIG. 23.

Referring now to FIGS. 23 and 24 of the drawings, the nozzle array 114 is described in greater detail. The array 114 is for a four color printhead. Accordingly, the array 114 includes four groups 170 of nozzle assemblies, one for each color. Each group 170 has its nozzle assemblies 110 arranged in two rows 172 and 174. One of the groups 170 is shown in greater detail in FIG. 24 of the drawings.

To facilitate close packing of the nozzle assemblies 110 in the rows 172 and 174, the nozzle assemblies 110 in the row 174 are offset or staggered with respect to the nozzle assemblies 110 in the row 172. Also, the nozzle assemblies 110 in the row 172 are spaced apart sufficiently far from each other to enable the lever arms 126 of the nozzle assemblies 110 in the row 174 to pass between adjacent nozzles 122 of the assemblies 110 in the row 172. It is to be noted that each nozzle assembly 110 is substantially dumbbell shaped so that the nozzles 122 in the row 172 nest between the nozzles 122 and the actuators 128 of adjacent nozzle assemblies 110 in the row 174.

Further, to facilitate close packing of the nozzles 122 in the rows 172 and 174, each nozzle 122 is substantially hexagonally shaped.

It will be appreciated by those skilled in the art that, when the nozzles 122 are displaced towards the substrate 116, in use, due to the nozzle opening 124 being at a slight angle with respect to the nozzle chamber 134 ink is ejected slightly off the perpendicular. It is an advantage of the arrangement shown in FIGS. 23 and 24 of the drawings that the actuators 128 of the nozzle assemblies 110 in the rows 172 and 174 extend in the same direction to one side of the rows 172 and 174. Hence, the ink droplets ejected from the nozzles 122 in the row 172 and the ink droplets ejected from the nozzles 122 in the row 174 are parallel to one another resulting in an improved print quality.

Also, as shown in FIG. 23 of the drawings, the substrate 116 has bond pads 176 arranged thereon which provide the electrical connections, via the pads 156, to the actuators 128 of the nozzle assemblies 110. These electrical connections are formed via the CMOS layer (not shown).

Figure 25:
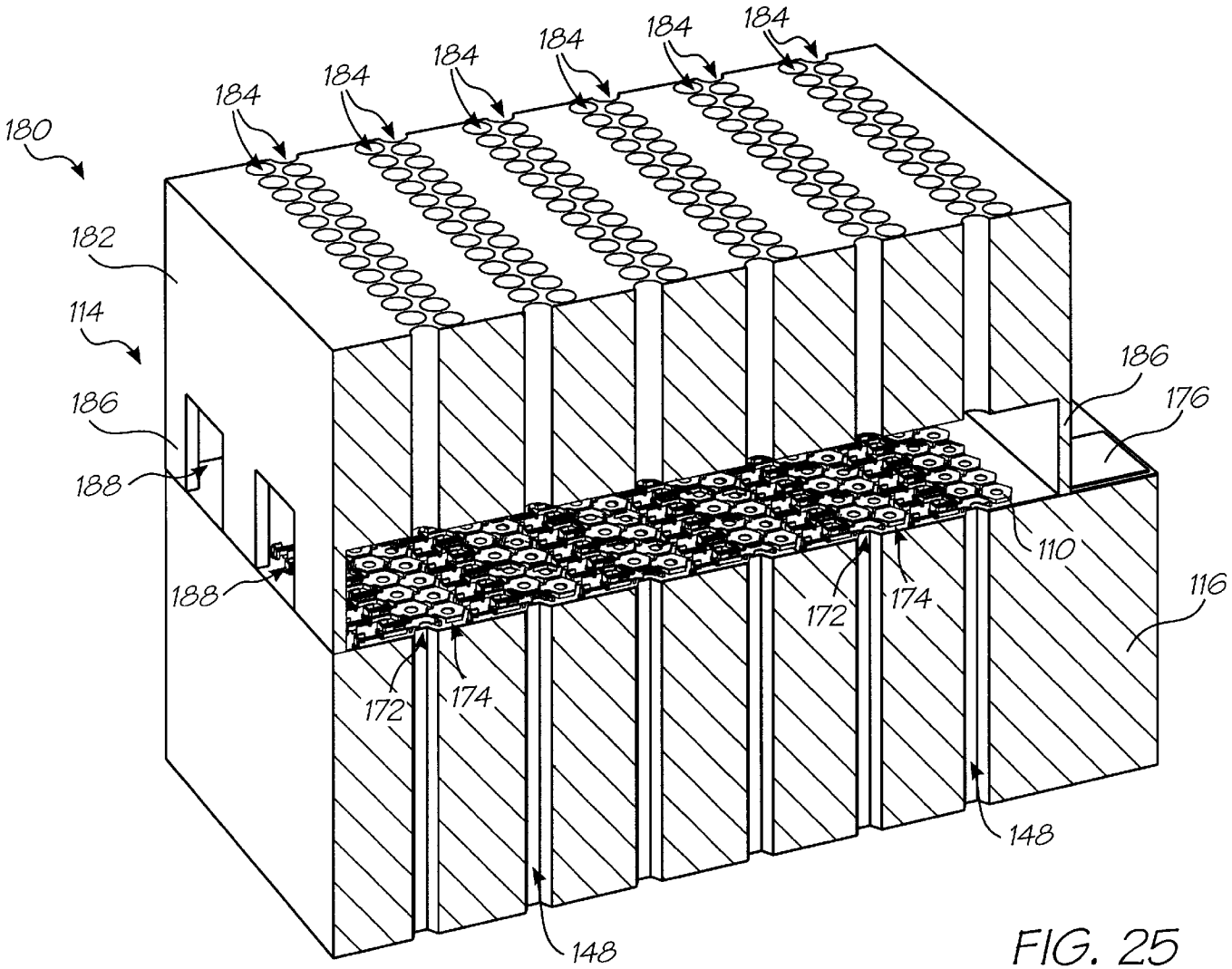
FIG. 25 shows a three dimensional view of an ink jet printhead including a nozzle guard.

Referring to FIG. 25 of the drawings, a development of the invention is shown. With reference to the previous drawings, like reference numerals refer to like parts, unless otherwise specified.

In this development, a nozzle guard 180 is mounted on the substrate 116 of the array 114. The nozzle guard 180 includes a body member 182 having a plurality of passages 184 defined therethrough. The passages 184 are in register with the nozzle openings 124 of the nozzle assemblies 110 of the array 114 such that, when ink is ejected from any one of the nozzle openings 124, the ink passes through the associated passage 184 before striking the print media.

The body member 182 is mounted in spaced relationship relative to the nozzle assemblies 110 by limbs or struts 186. One of the struts 186 has air inlet openings 188 defined therein.

In use, when the array 114 is in operation, air is charged through the inlet openings 188 to be forced through the passages 184 together with ink travelling through the passages 184.

The ink is not entrained in the air as the air is charged through the passages 184 at a different velocity from that of the ink droplets 164. For example, the ink droplets 164 are ejected from the nozzles 122 at a velocity of approximately 3 m/s. The air is charged through the passages 184 at a velocity of approximately 1 m/s.

The purpose of the air is to maintain the passages 184 clear of foreign particles. A danger exists that these foreign particles, such as dust particles, could fall onto the nozzle assemblies 110 adversely affecting their operation. With the provision of the air inlet openings 88 in the nozzle guard 180 this problem is, to a large extent, obviated.

Referring now to FIGS. 26 to 28 of the drawings, a process for manufacturing the nozzle assemblies 110 is described.

Starting with the silicon substrate or wafer 116, the dielectric layer 118 is deposited on a surface of the wafer 116. The dielectric layer 118 is in the form of approximately 1.5 microns of CVD oxide. Resist is spun on to the layer 118 and the layer 118 is exposed to mask 200 and is subsequently developed.

After being developed, the layer 118 is plasma etched down to the silicon layer 116. The resist is then stripped and the layer 118 is cleaned. This step defines the ink inlet aperture 142.

Figure 26A:
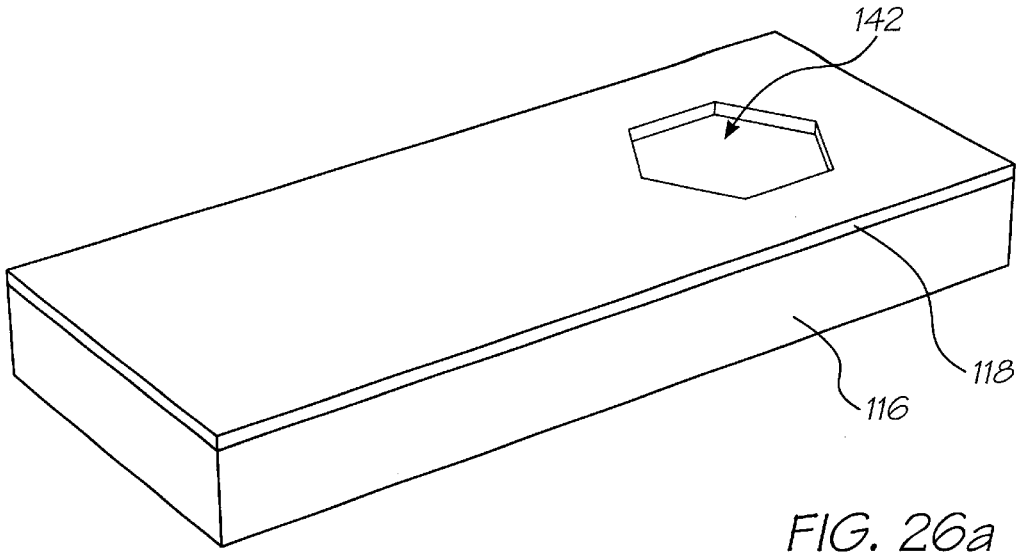
FIGS. 26*a* to 26*r* show three-dimensional views of steps in the manufacture of a nozzle assembly of an ink jet printhead.
Figure 27A:
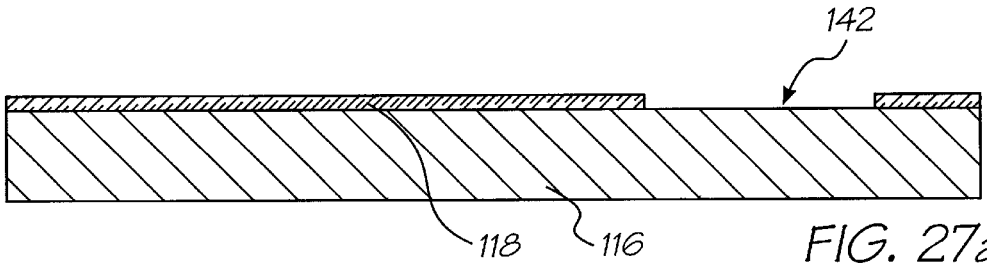
FIGS. 27*a* to 27*r* show sectional side views of the manufacturing steps.
Figure 28A:
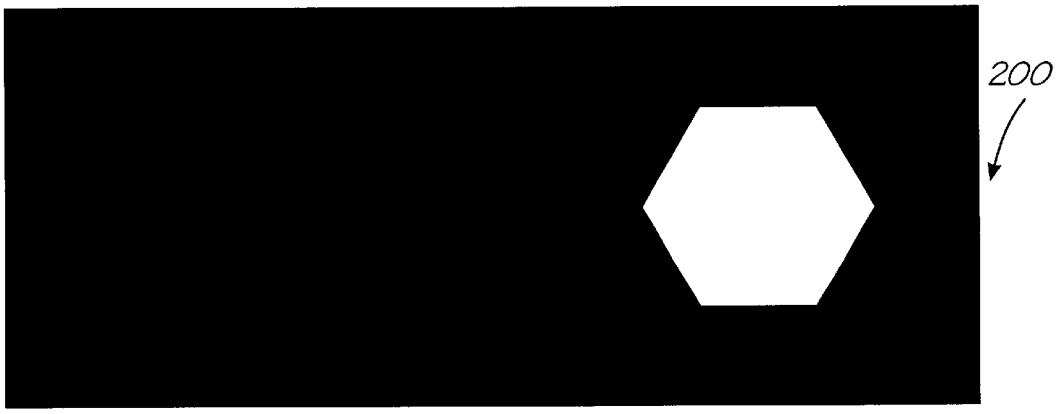
FIGS. 28*a* to 28*k* show layouts of masks used in various steps in the manufacturing process.
Figure 26B:
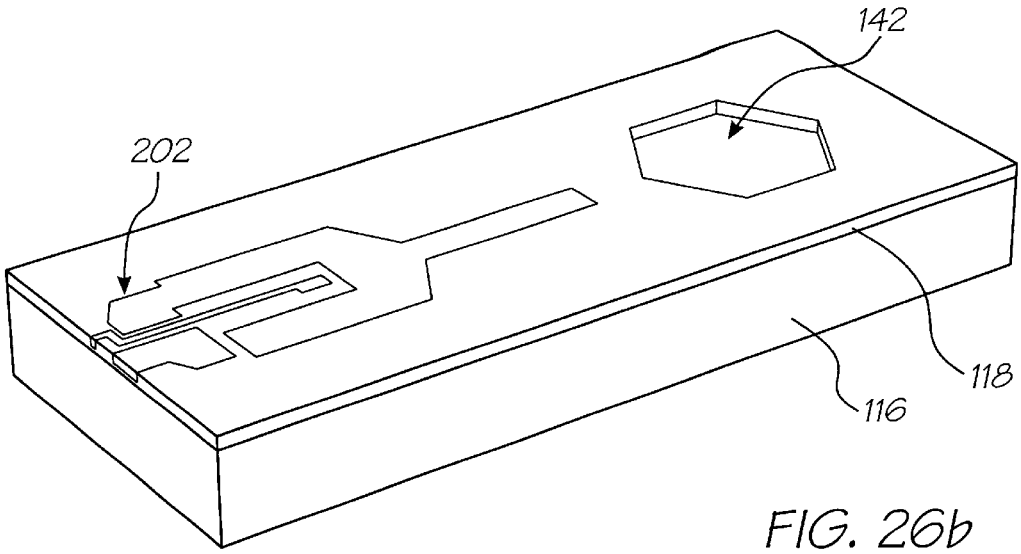
Figure 27B:
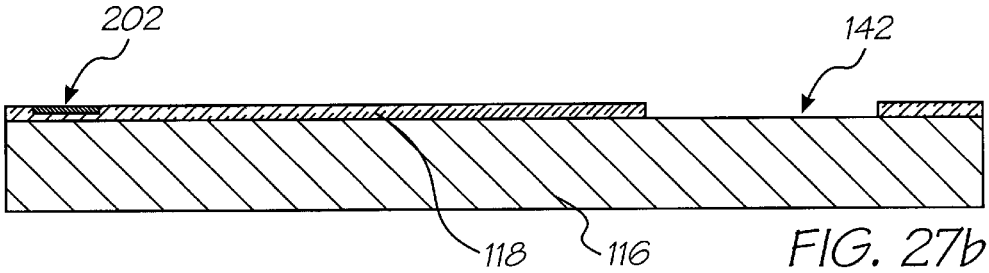
Figure 28B:
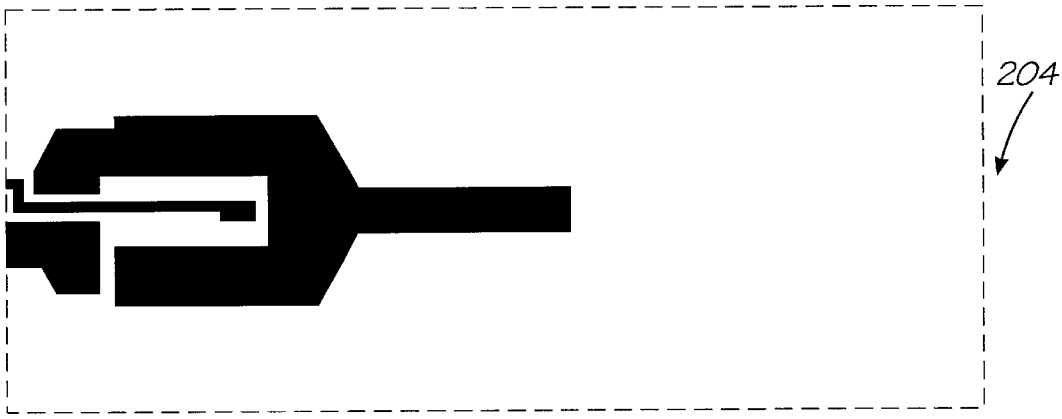
Figure 26C:
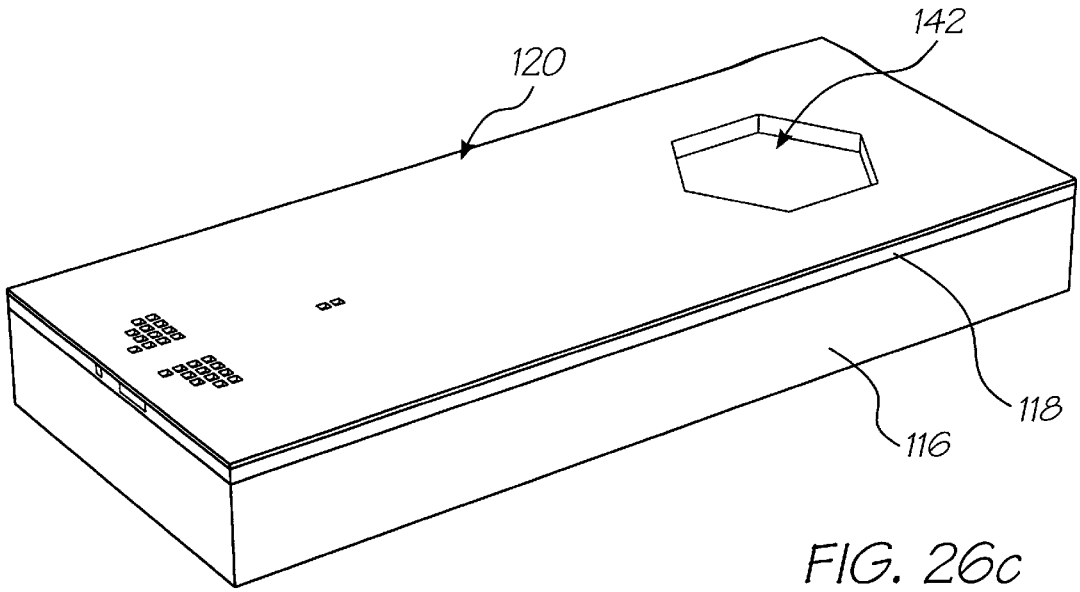
Figure 27C:
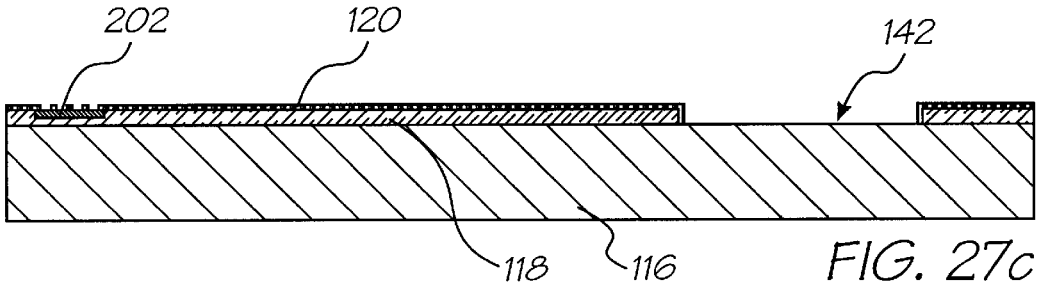
Figure 28C:
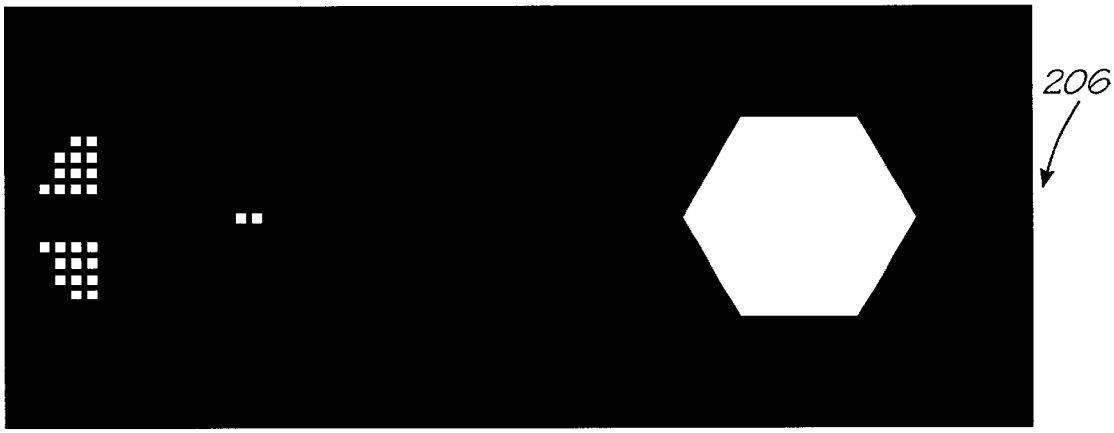
Figure 26D:
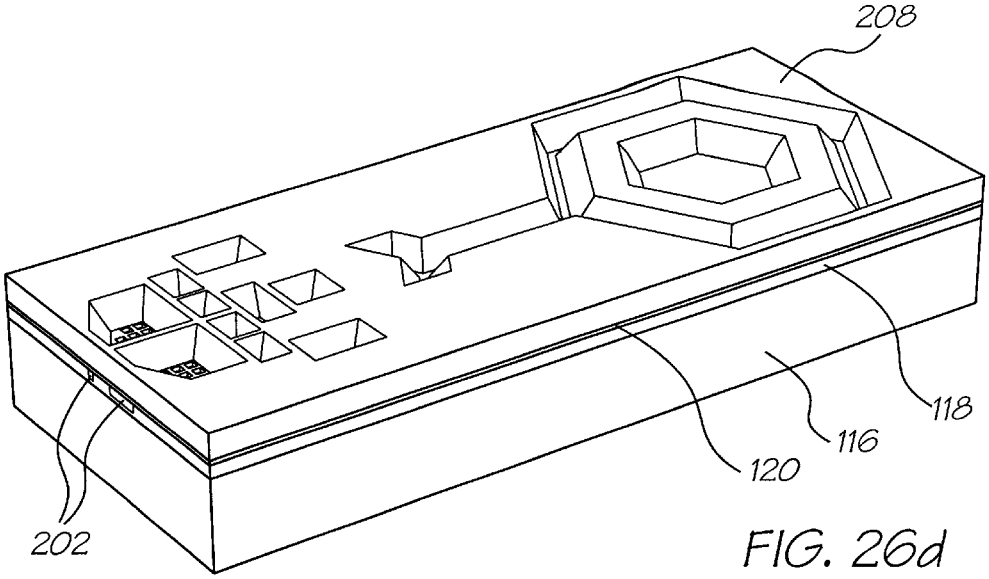
Figure 27D:
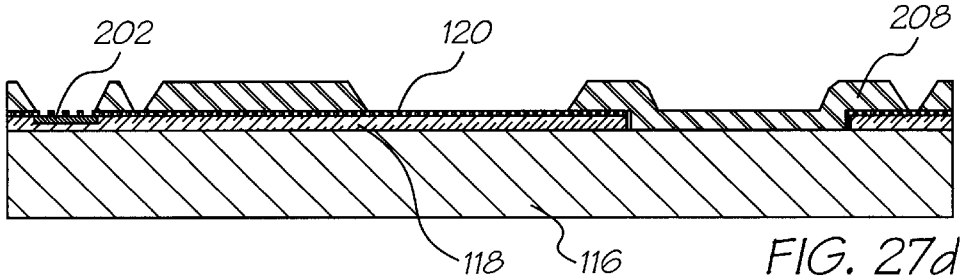
Figure 28D:
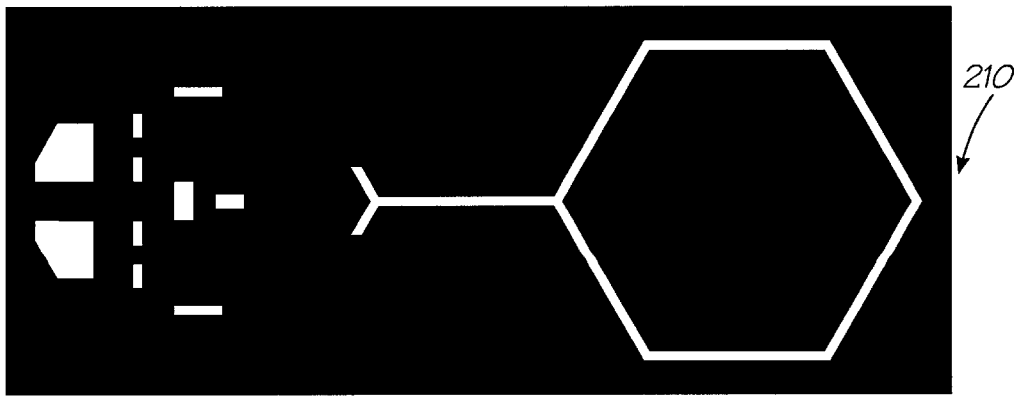

In FIG. 26*b* of the drawings, approximately 0.8 microns of aluminum 202 is deposited on the layer 118. Resist is spun on and the aluminum 202 is exposed to mask 204 and developed. The aluminum 202 is plasma etched down to the oxide layer 118, the resist is stripped and the device is cleaned. This step provides the bond pads and interconnects to the ink jet actuator 128. This interconnect is to an NMOS drive transistor and a power plane with connections made in the CMOS layer (not shown).

Approximately 0.5 microns of PECVD nitride is deposited as the CMOS passivation layer 120. Resist is spun on and the layer 120 is exposed to mask 206 whereafter it is developed. After development, the nitride is plasma etched down to the aluminum layer 202 and the silicon layer 116 in the region of the inlet aperture 142. The resist is stripped and the device cleaned.

A layer 208 of a sacrificial material is spun on to the layer 120. The layer 208 is 6 microns of photo-sensitive polyimide or approximately 4 μm of high temperature resist. The layer 208 is softbaked and is then exposed to mask 210 whereafter it is developed. The layer 208 is then hardbaked at 400° C. for one hour where the layer 208 is comprised of polyimide or at greater than 300° C. where the layer 208 is high temperature resist. It is to be noted in the drawings that the pattern-dependent distortion of the polyimide layer 208 caused by shrinkage is taken into account in the design of the mask 210.

Figure 26E:
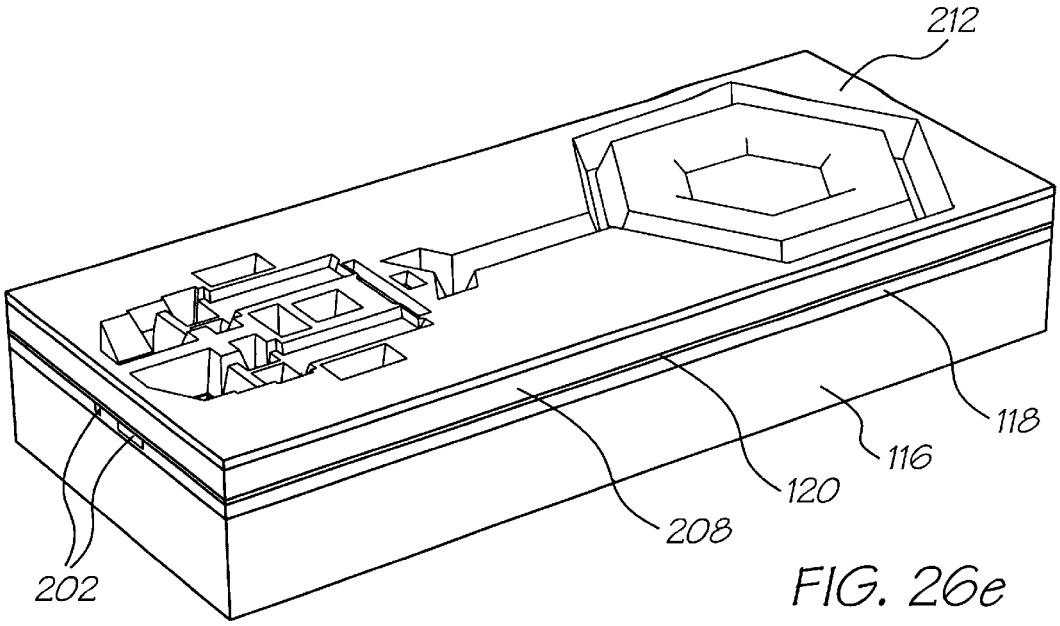
Figure 27E:
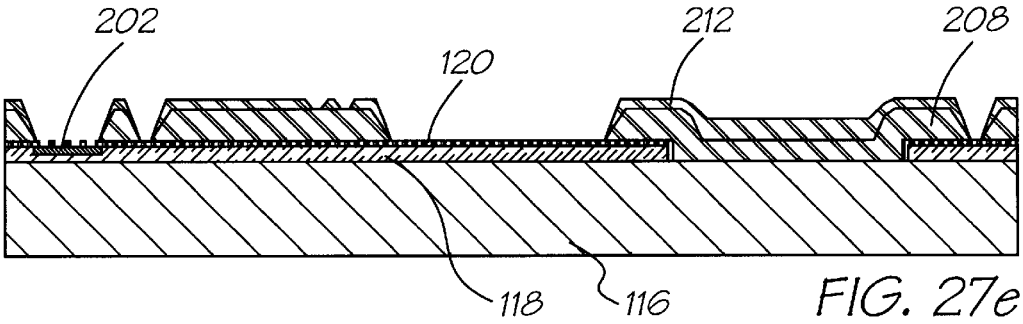
Figure 28E:
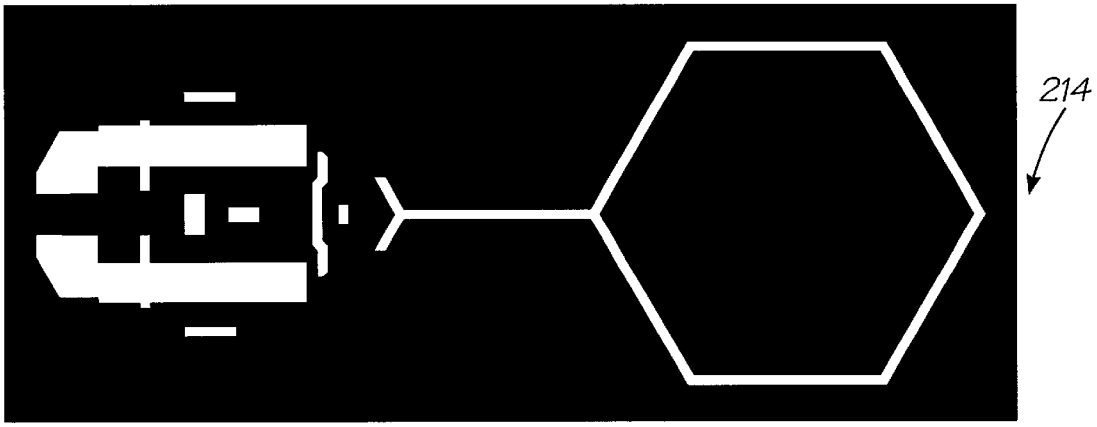
Figure 26F:
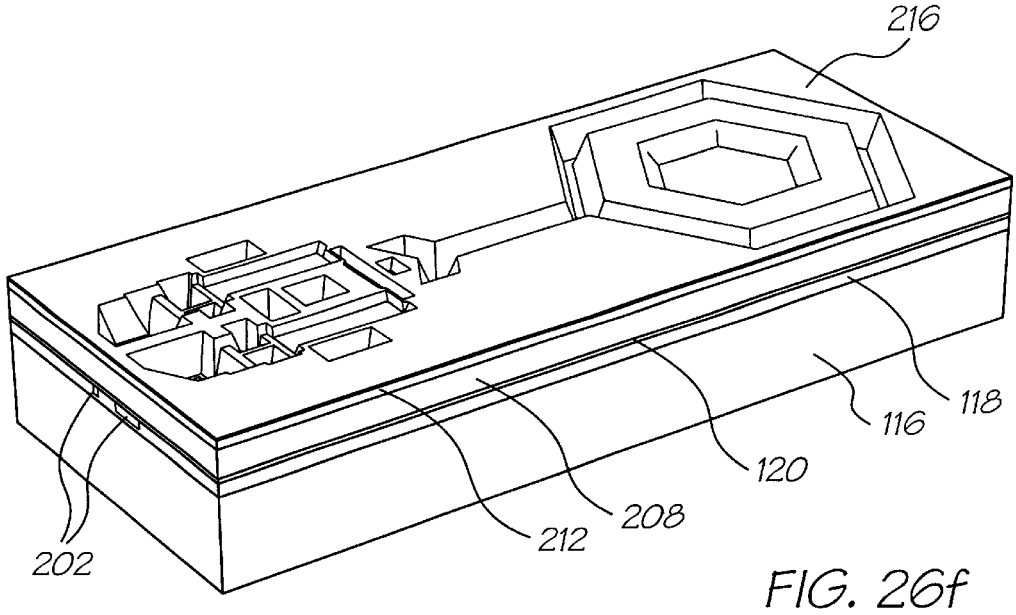
Figure 27F:
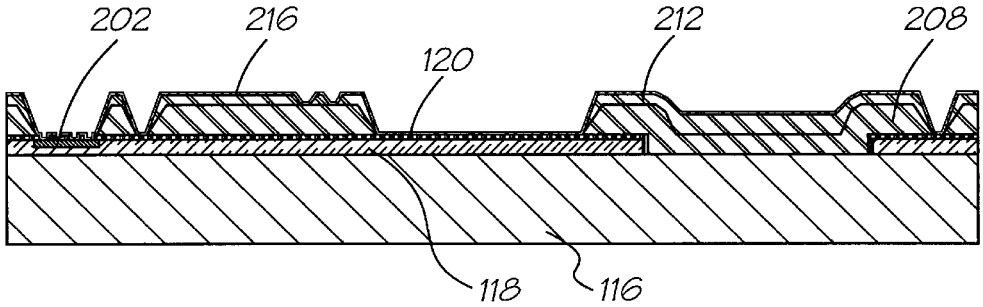
Figure 26G:
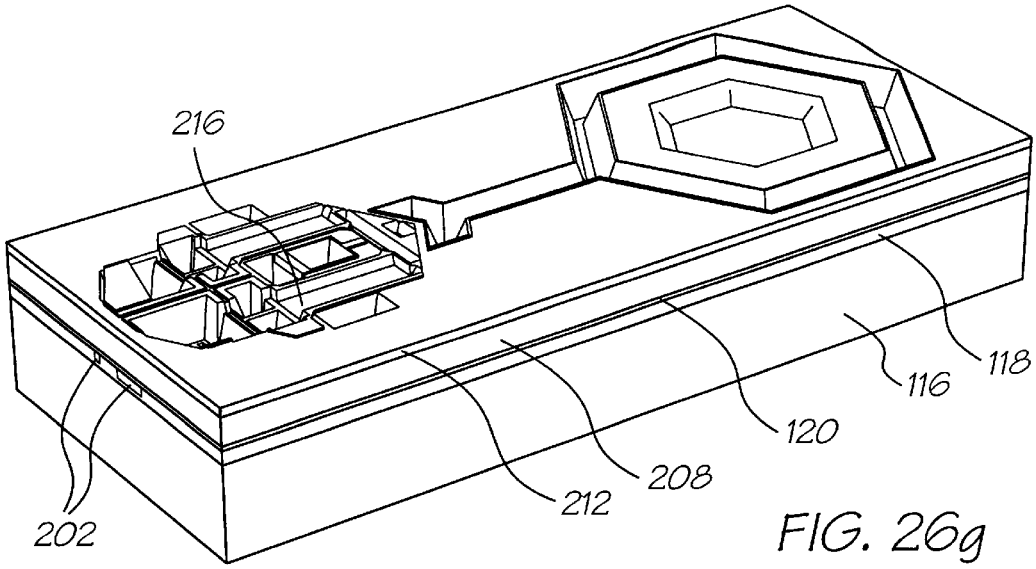
Figure 27G:
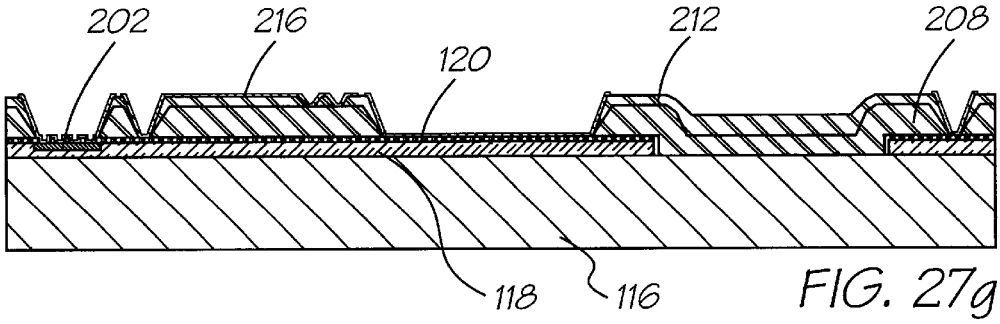
Figure 28F:
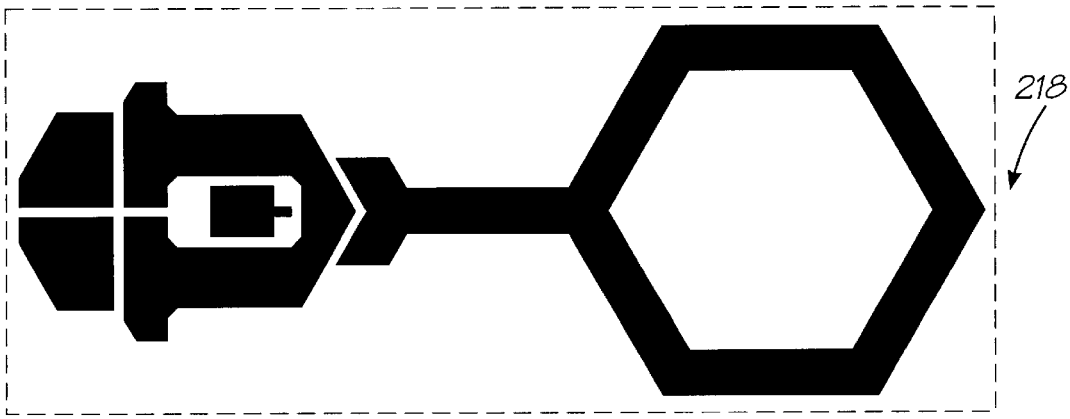
Figure 26H:
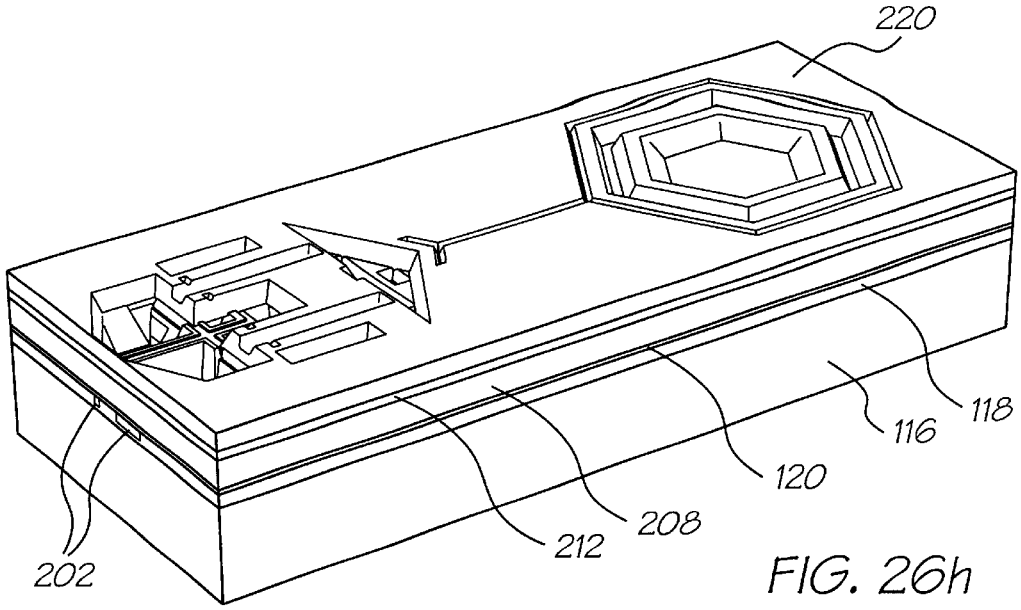
Figure 27H:
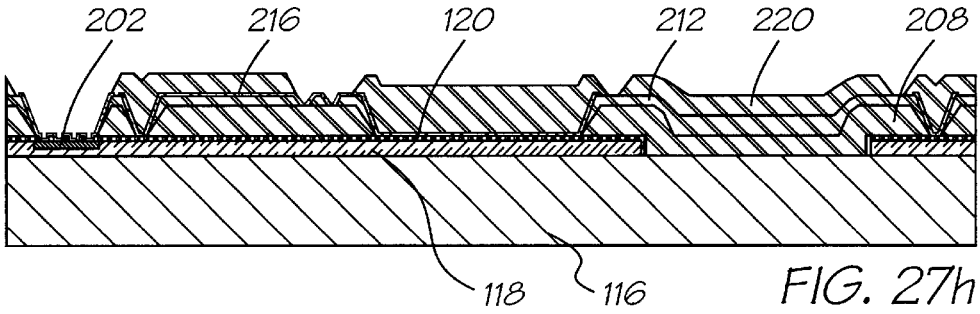
Figure 28G:
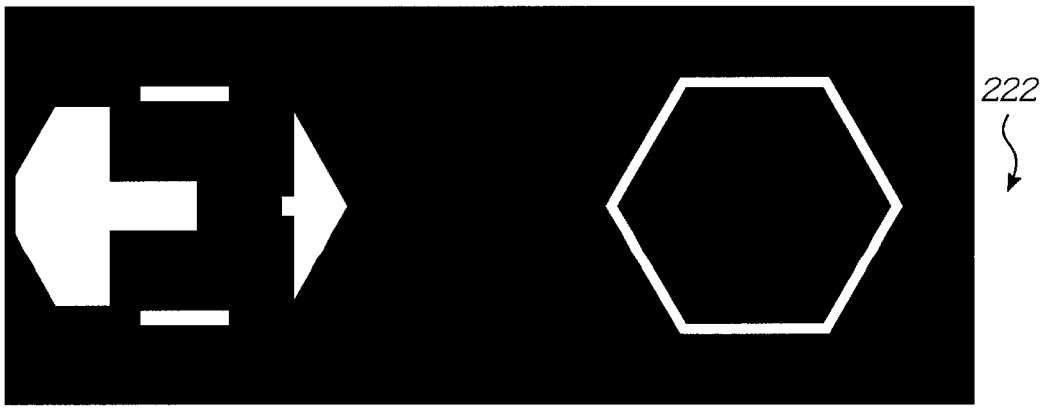
Figure 26I:
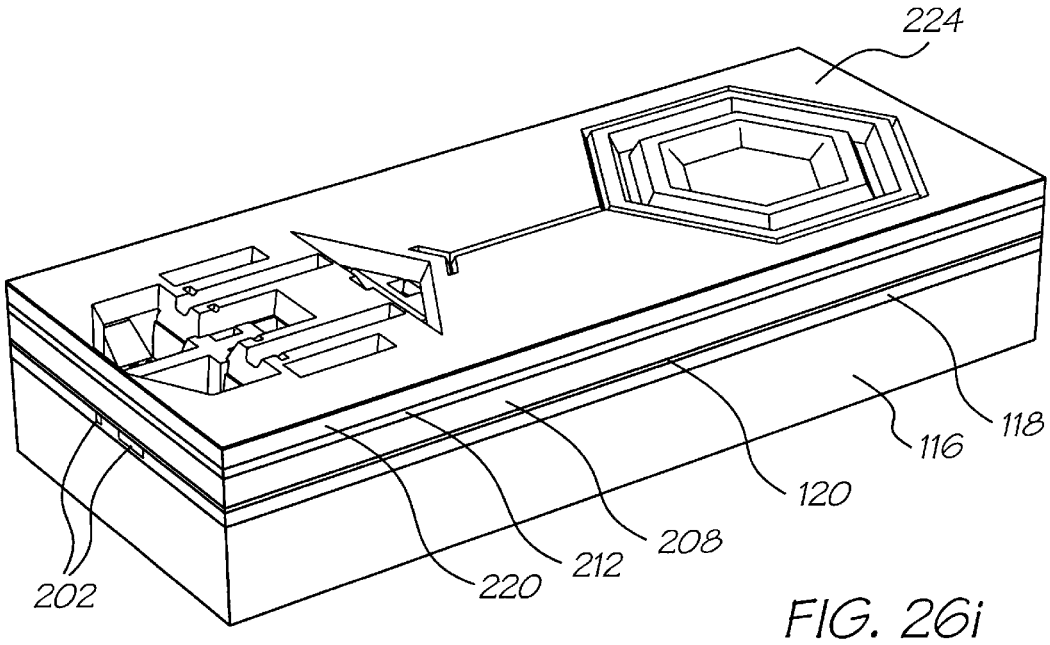
Figure 27I:
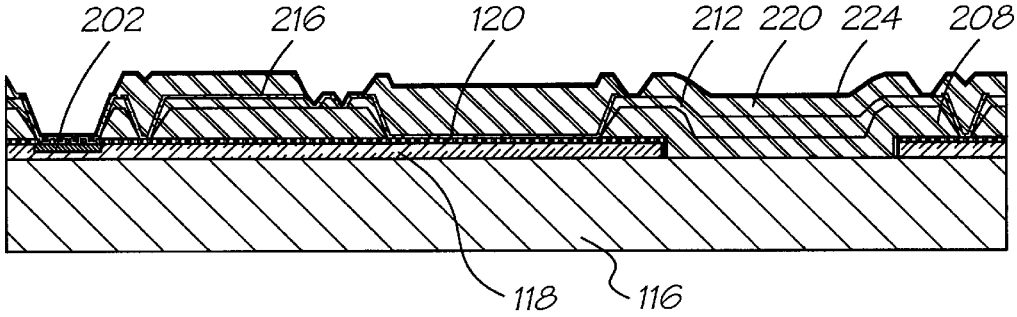
Figure 26J:
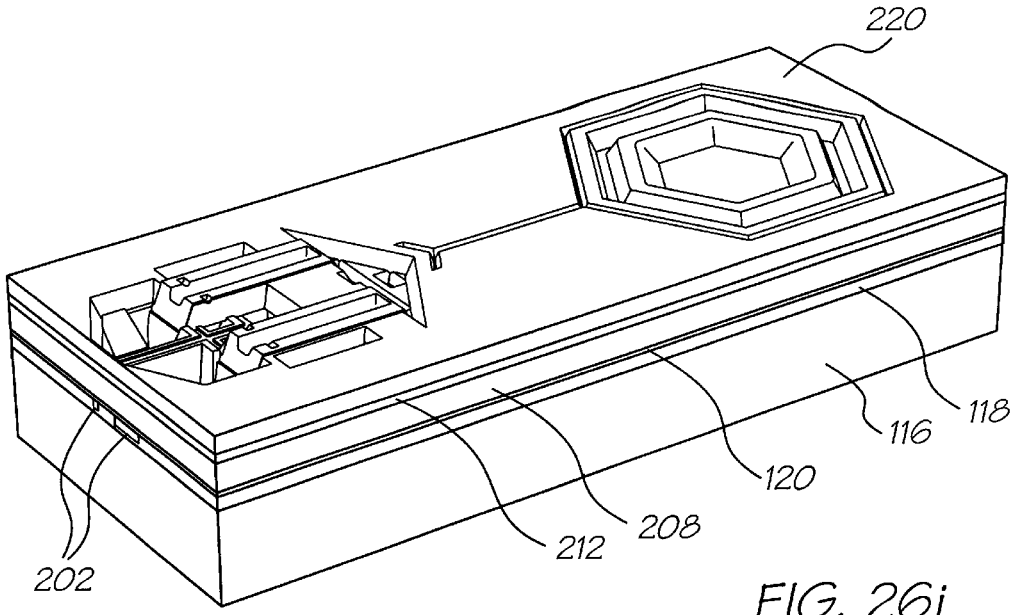
Figure 27J:
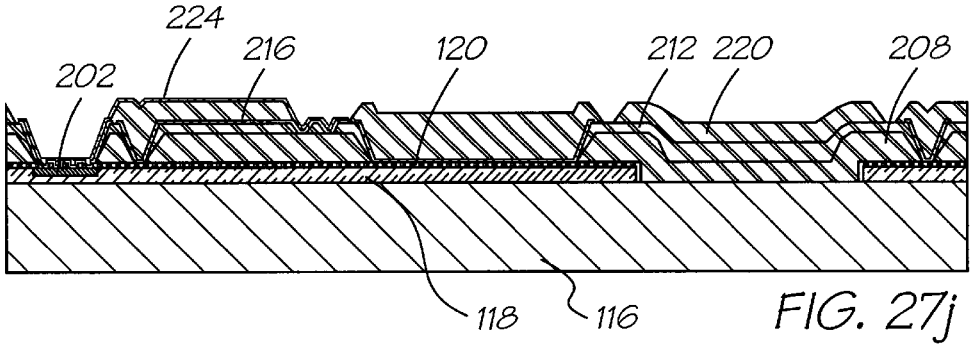
Figure 28H:
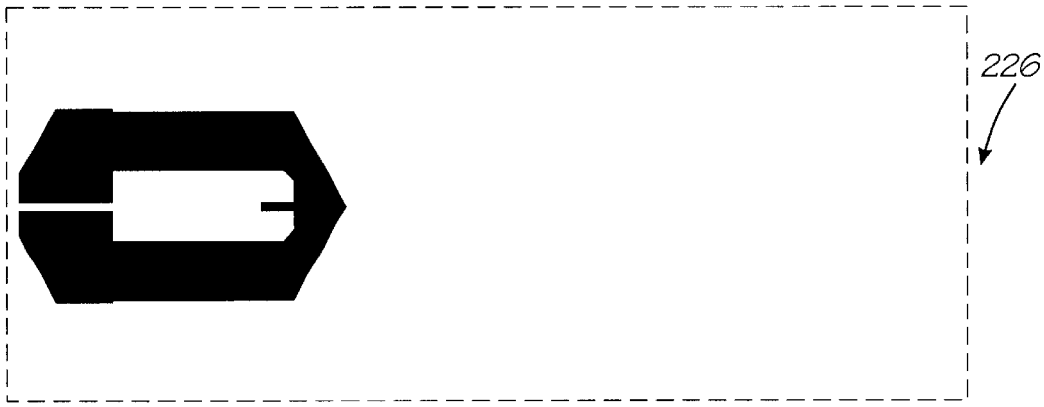
Figure 26K:
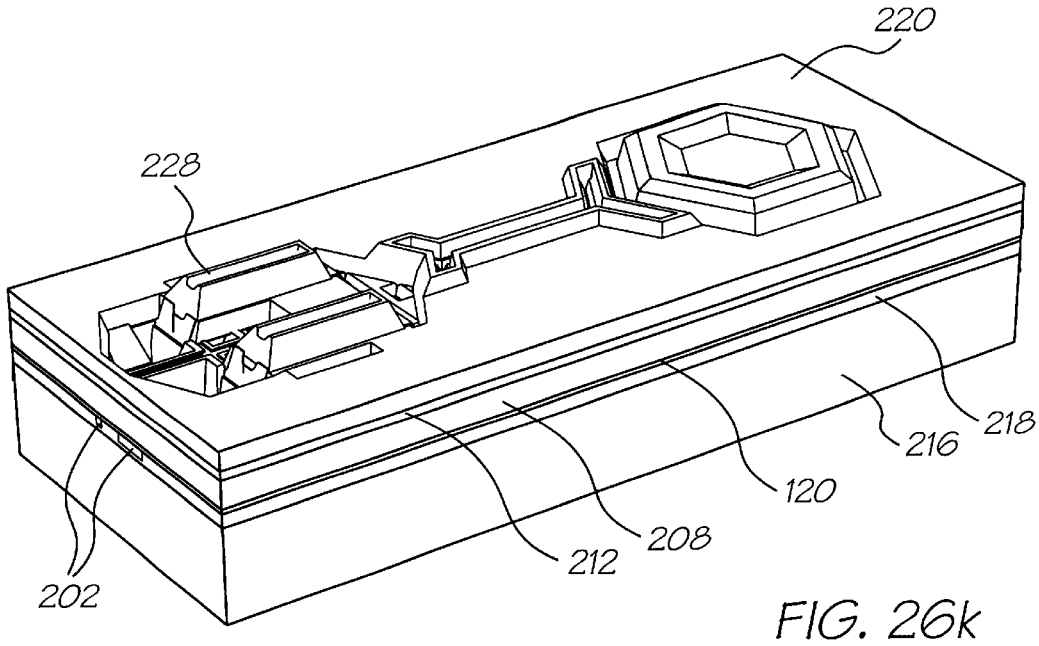
Figure 27K:
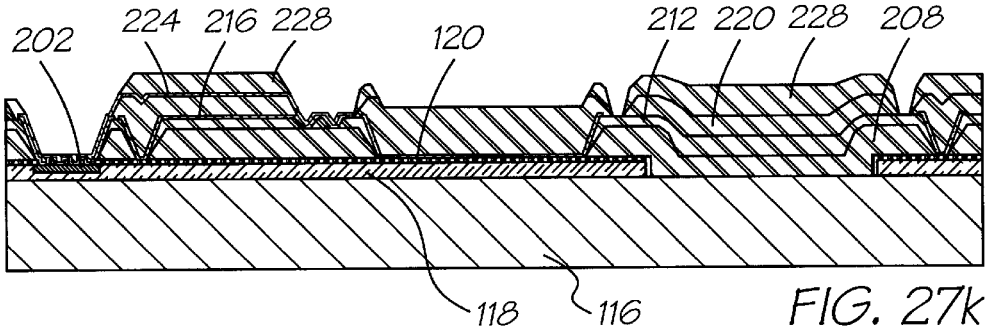
Figure 28I:
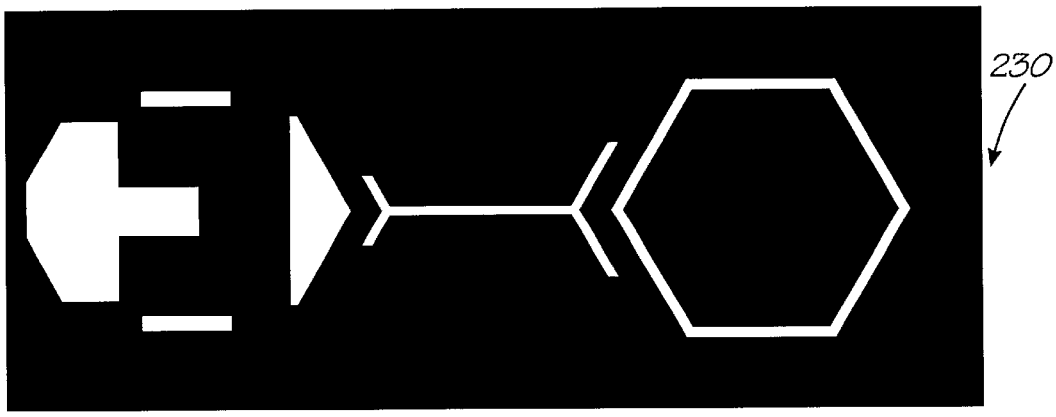
Figure 26I:
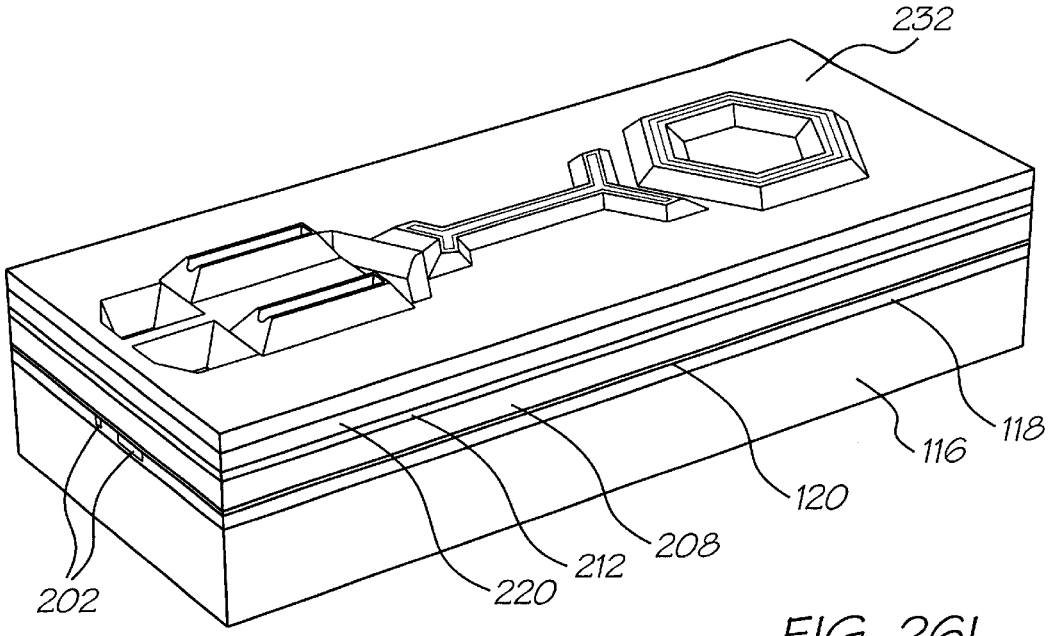
Figure 27I:
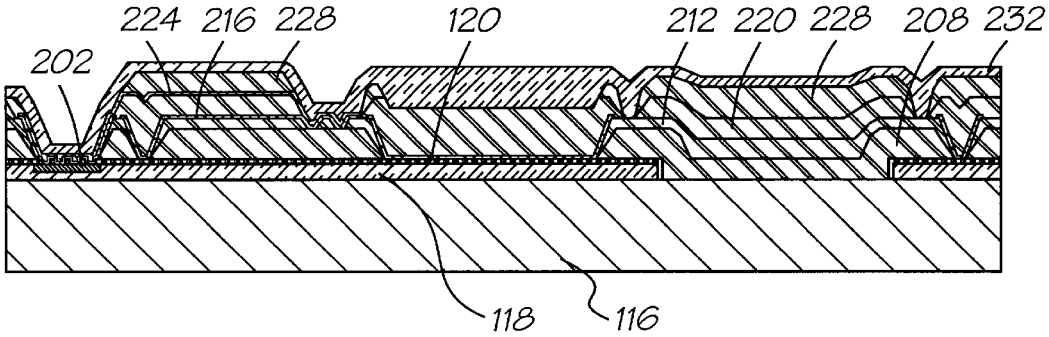
Figure 26M:
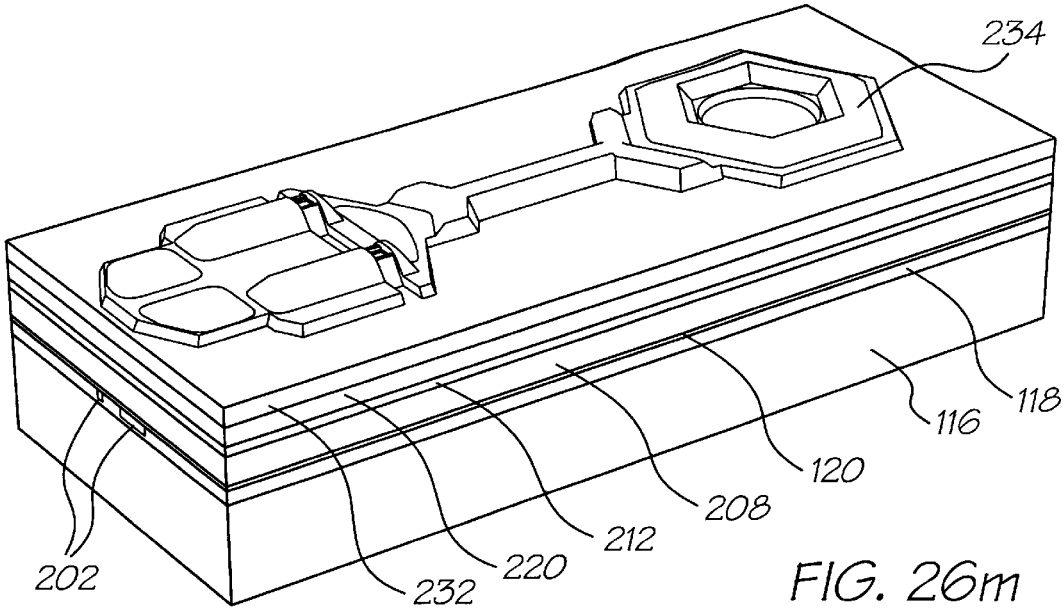
Figure 27M:
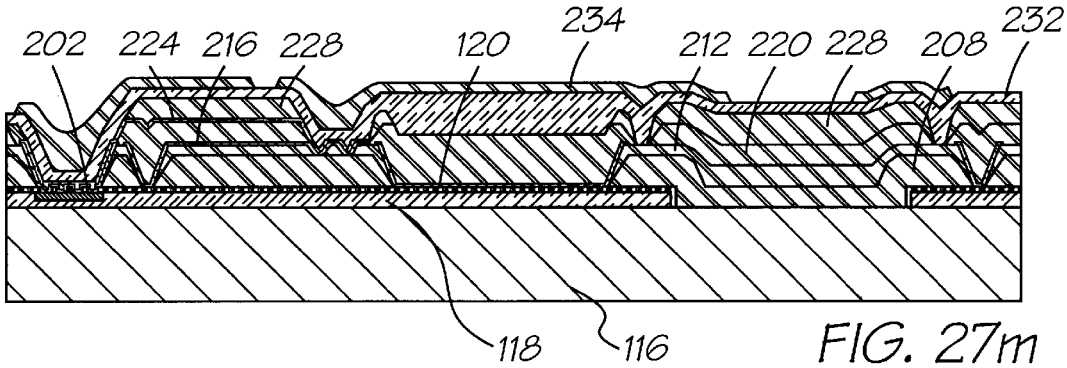
Figure 28J:
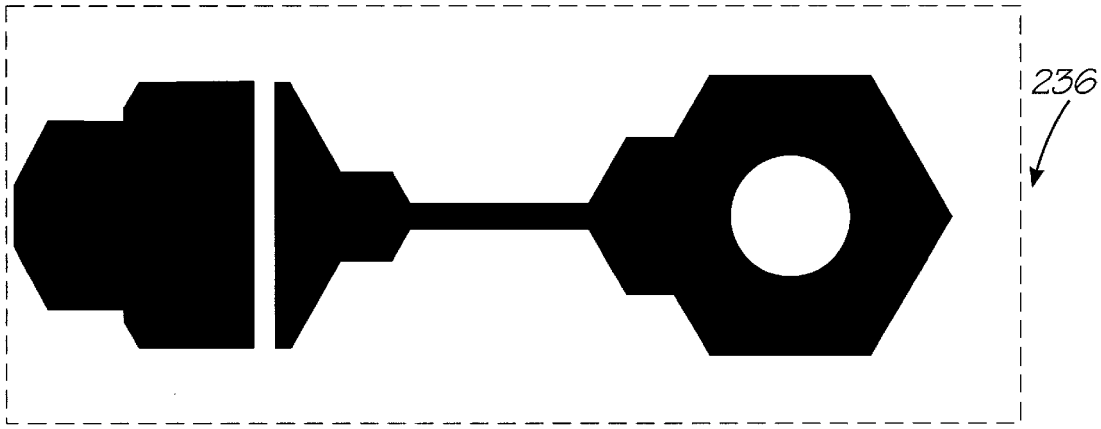
Figure 26N:
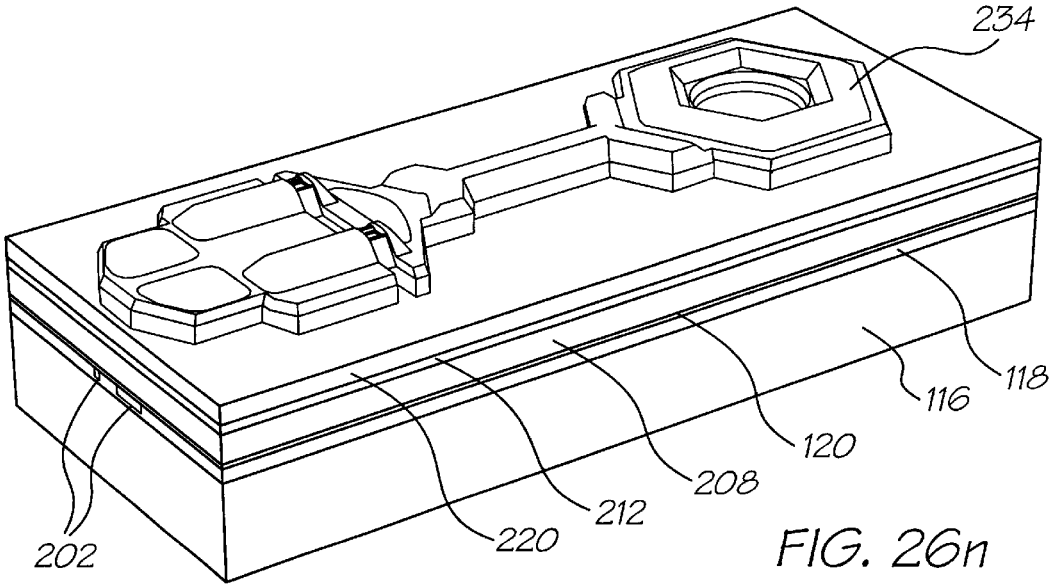
Figure 27N:
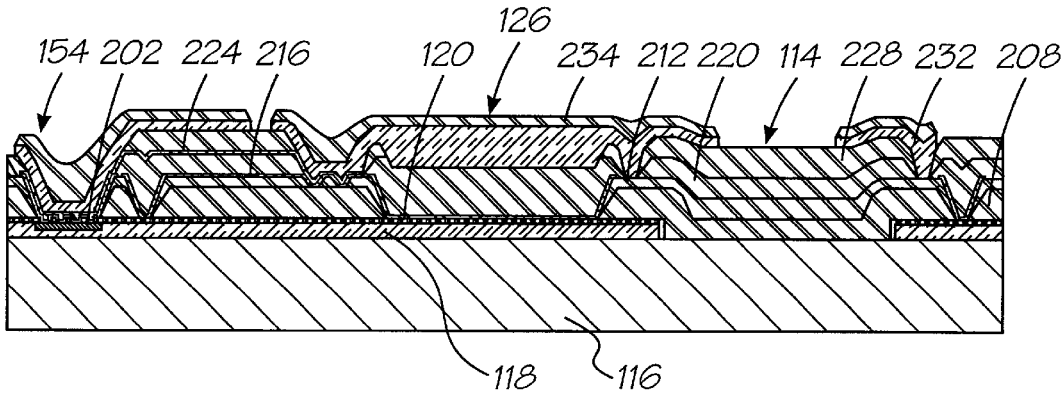
Figure 26O:
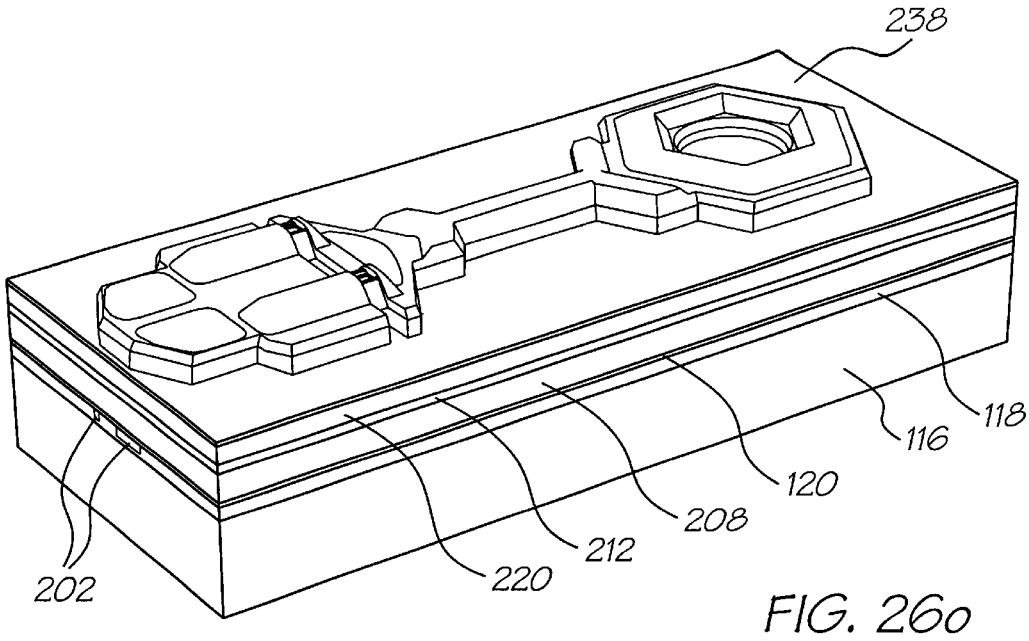
Figure 27O:
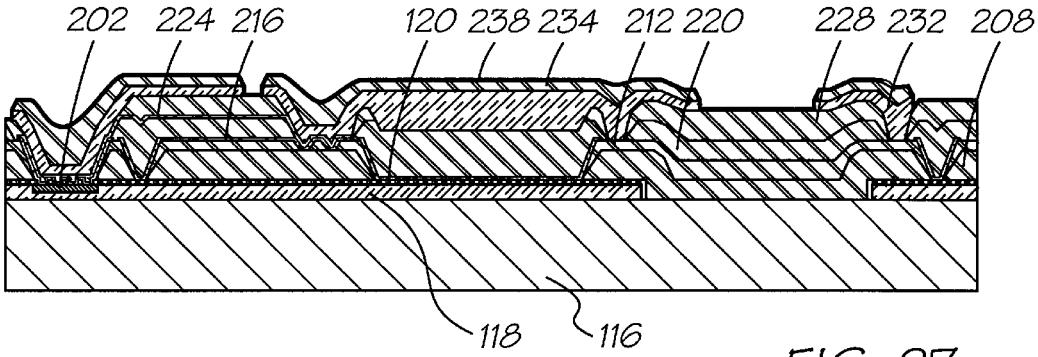

In the next step, shown in FIG. 26*e* of the drawings, a second sacrificial layer 212 is applied. The layer 212 is either 2 μm of photo-sensitive polyimide which is spun on or approximately 1.3 μn of high temperature resist. The layer 212 is softbaked and exposed to mask 214. After exposure to the mask 214, the layer 212 is developed. In the case of the layer 212 being polyimide, the layer 212 is hardbaked at 400° C. for approximately one hour. Where the layer 212 is resist, it is hardbaked at greater than 300° C. for approximately one hour.

A 0.2 micron multi-layer metal layer 216 is then deposited. Part of this layer 216 forms the passive beam 160 of the actuator 128.

The layer 216 is formed by sputtering 1,000 Å of titanium nitride (TiN) at around 300° C. followed by sputtering 50 Å of tantalum nitride (TaN). A further 1,000 Å of TiN is sputtered on followed by 50 Å of TaN and a further 1,000 Å of TiN.

Other materials which can be used instead of TiN are $TiB_2$, $MoSi_2$ or (Ti, Al)N.

The layer 216 is then exposed to mask 218, developed and plasma etched down to the layer 212 whereafter resist, applied for the layer 216, is wet stripped taking care not to remove the cured layers 208 or 212.

A third sacrificial layer 220 is applied by spinning on 4 μm of photo-sensitive polyimide or approximately 2.6 μm high temperature resist. The layer 220 is softbaked whereafter it is exposed to mask 222. The exposed layer is then developed followed by hardbaking. In the case of polyimide, the layer 220 is hardbaked at 400° C. for approximately one hour or at greater than 300° C. where the layer 220 comprises resist.

A second multilayer metal layer 224 is applied to the layer 220. The constituents of the layer 224 are the same as the layer 216 and are applied in the same manner. It will be appreciated that both layers 216 and 224 are electrically conductive layers.

The layer 224 is exposed to mask 226 and is then developed. The layer 224 is plasma etched down to the polyimide or resist layer 220 whereafter resist applied for the layer 224 is wet stripped taking care not to remove the cured layers 208, 212 or 220. It will be noted that the remaining part of the layer 224 defines the active beam 158 of the actuator 128.

A fourth sacrificial layer 228 is applied by spinning on 4 μm of photo-sensitive polyimide or approximately 2.6 μm of high temperature resist. The layer 228 is softbaked, exposed to the mask 230 and is then developed to leave the island portions as shown in FIG. 9*k* of the drawings. The remaining portions of the layer 228 are hardbaked at 400° C. for approximately one hour in the case of polyimide or at greater than 300° C. for resist.

As shown in FIG. 26*l* of the drawing a high Young's modulus dielectric layer 232 is deposited. The layer 232 is constituted by approximately 1 μm of silicon nitride or aluminum oxide. The layer 232 is deposited at a temperature below the hardbaked temperature of the sacrificial layers 208, 212, 220, 228. The primary characteristics required for this dielectric layer 232 are a high elastic modulus, chemical inertness and good adhesion to TiN.

A fifth sacrificial layer 234 is applied by spinning on 2 μm of photo-sensitive polyimide or approximately 1.3 μm of high temperature resist. The layer 234 is softbaked, exposed to mask 236 and developed. The remaining portion of the layer 234 is then hardbaked at 400° C. for one hour in the case of the polyimide or at greater than 300° C. for the resist.

The dielectric layer 232 is plasma etched down to the sacrificial layer 228 taking care not to remove any of the sacrificial layer 234.

This step defines the nozzle opening 124, the lever arm 126 and the anchor 154 of the nozzle assembly 110.

A high Young's modulus dielectric layer 238 is deposited. This layer 238 is formed by depositing 0.2 μm of silicon nitride or aluminum nitride at a temperature below the hardbaked temperature of the sacrificial layers 208, 212, 220 and 228.

Figure 26P:
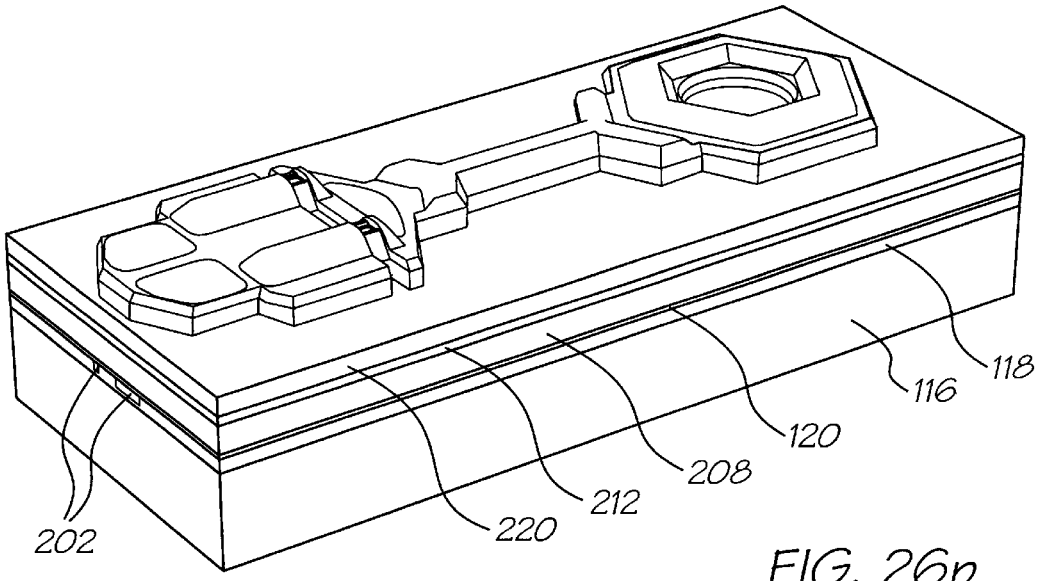
Figure 27P:
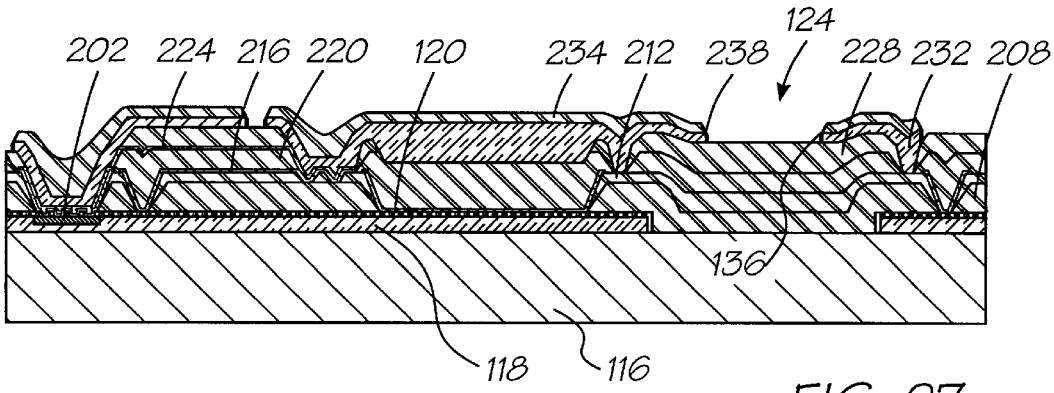
Figure 26Q:
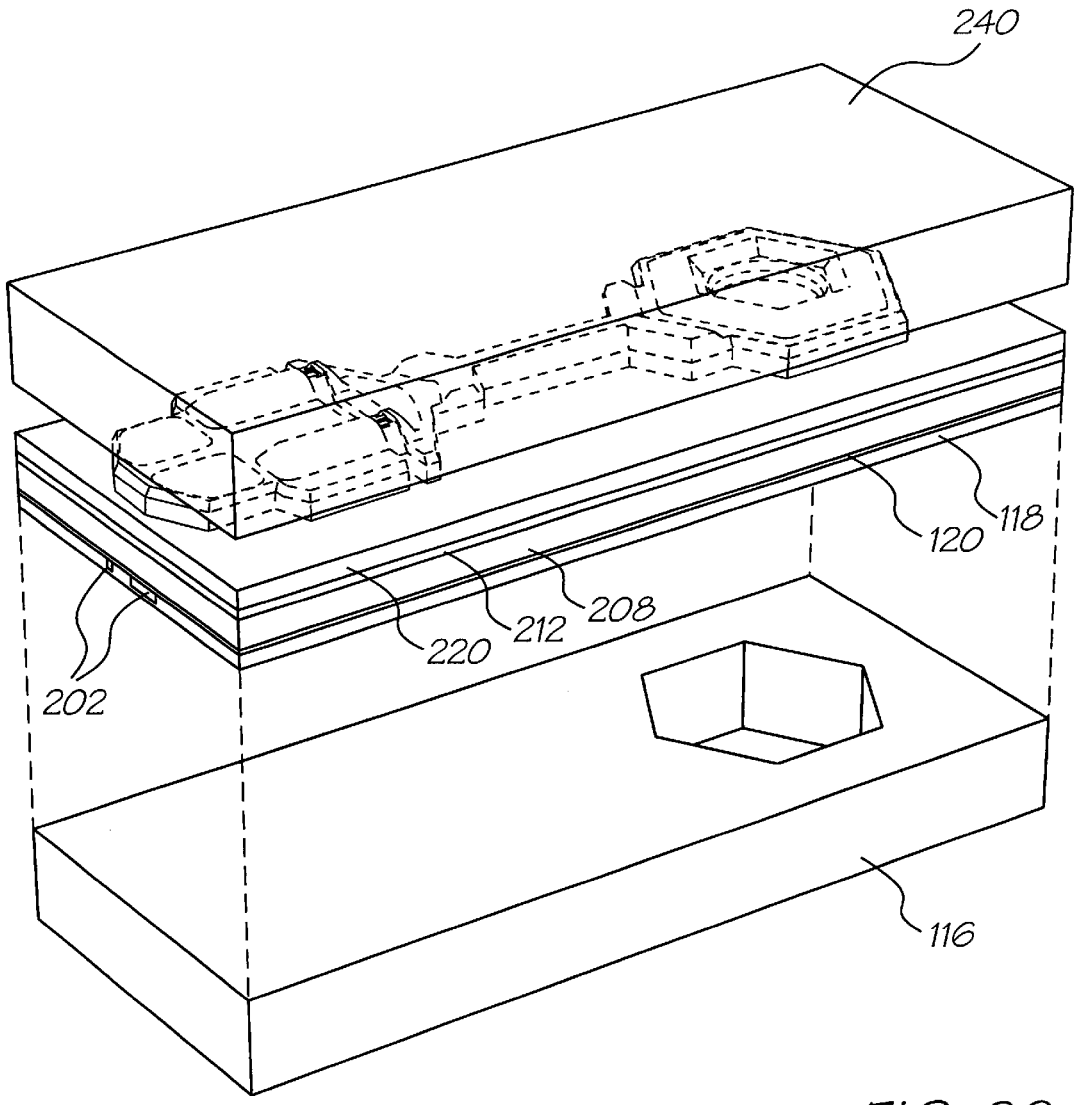

Then, as shown in FIG. 26*p* of the drawings, the layer 238 is anisotropically plasma etched to a depth of 0.35 microns. This etch is intended to clear the dielectric from all of the surface except the side walls of the dielectric layer 232 and the sacrificial layer 234. This step creates the nozzle rim 136 around the nozzle opening 124 which "pins" the meniscus of ink, as described above.

An ultraviolet (UV) release tape 240 is applied. 4 μm of resist is spun on to a rear of the silicon wafer 116. The wafer 116 is exposed to mask 242 to back etch the wafer 116 to define the ink inlet channel 148. The resist is then stripped from the wafer 116.

Figure 26R:
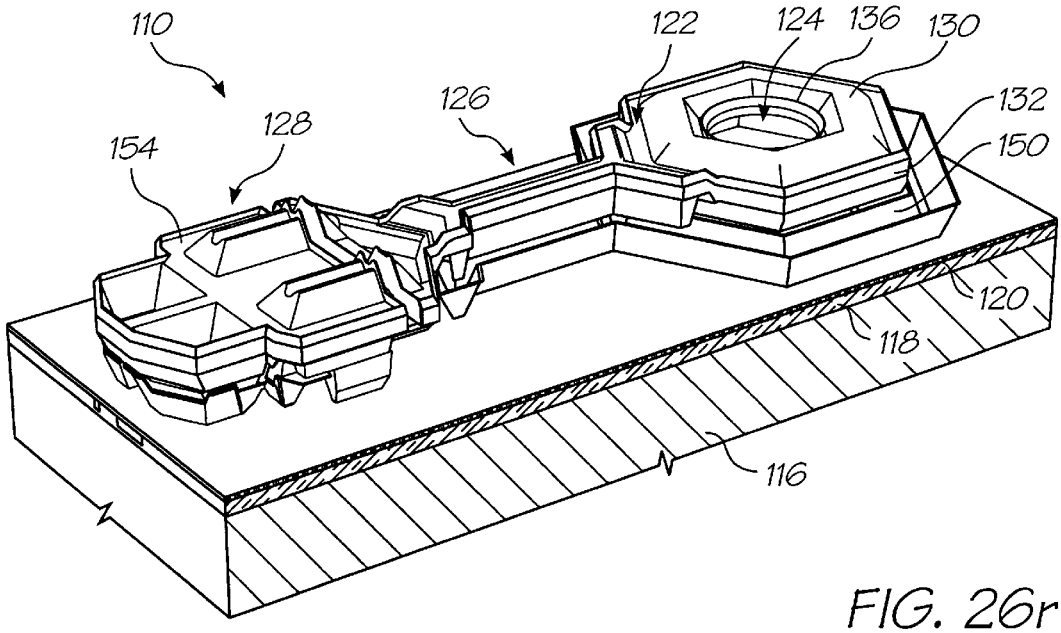
Figure 27R:
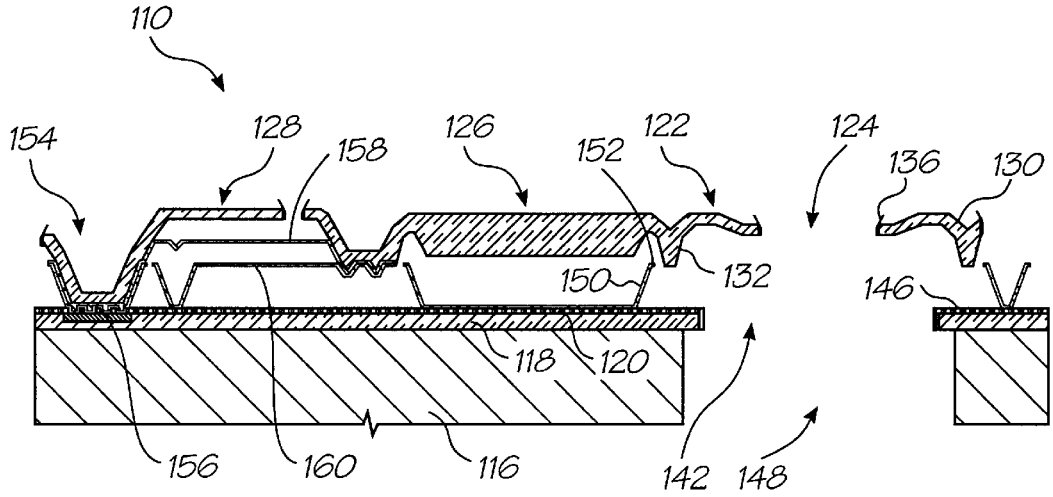
Figure 27Q:
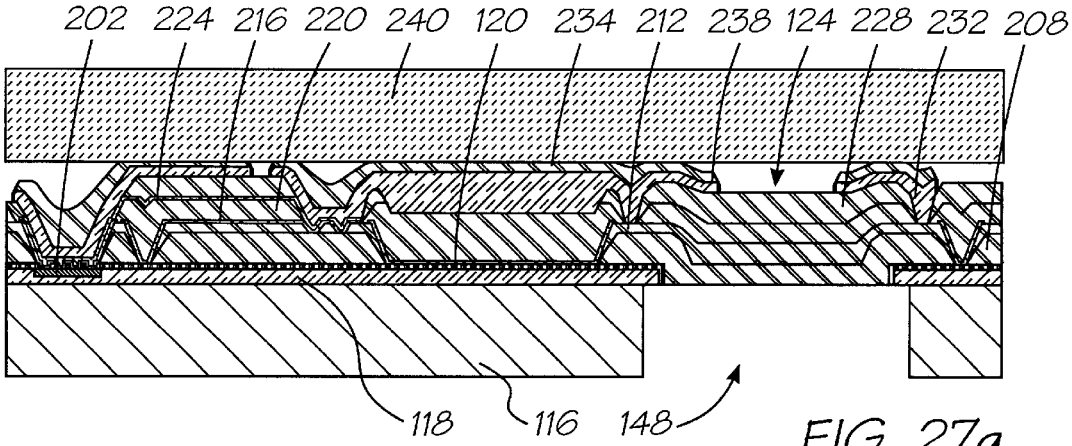
Figure 28K:
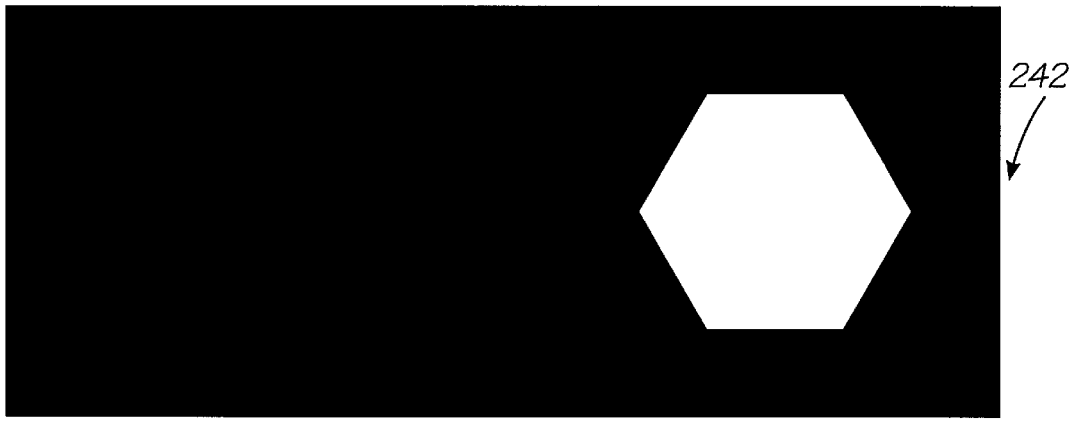
Figure 29A:
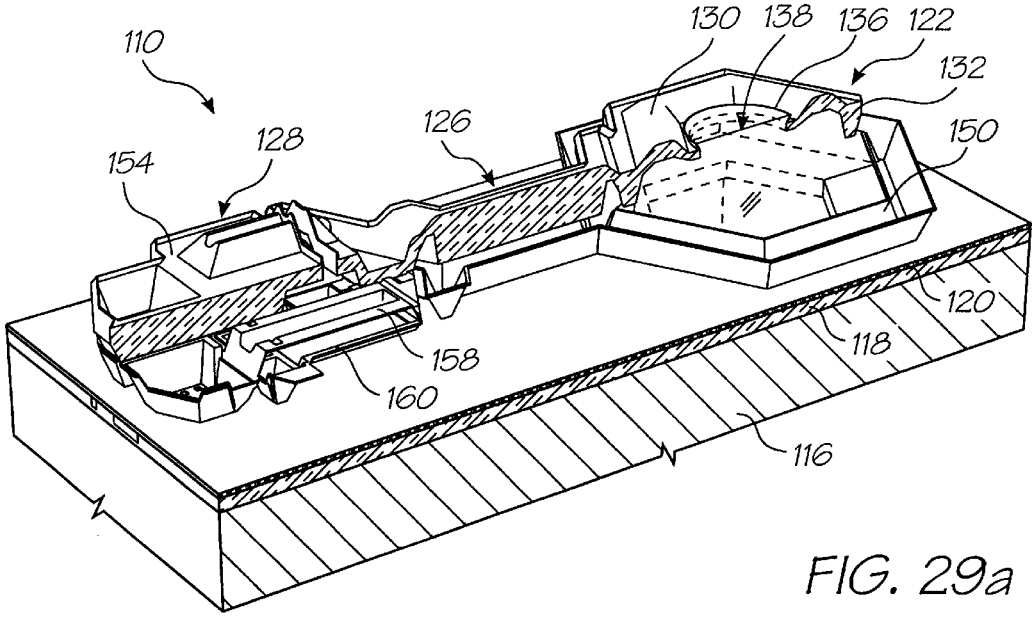
FIGS. 29*a* to 29*c* show three dimensional views of an operation of the nozzle assembly manufactured according to the method of FIGS. 26 and 27.
Figure 30A:
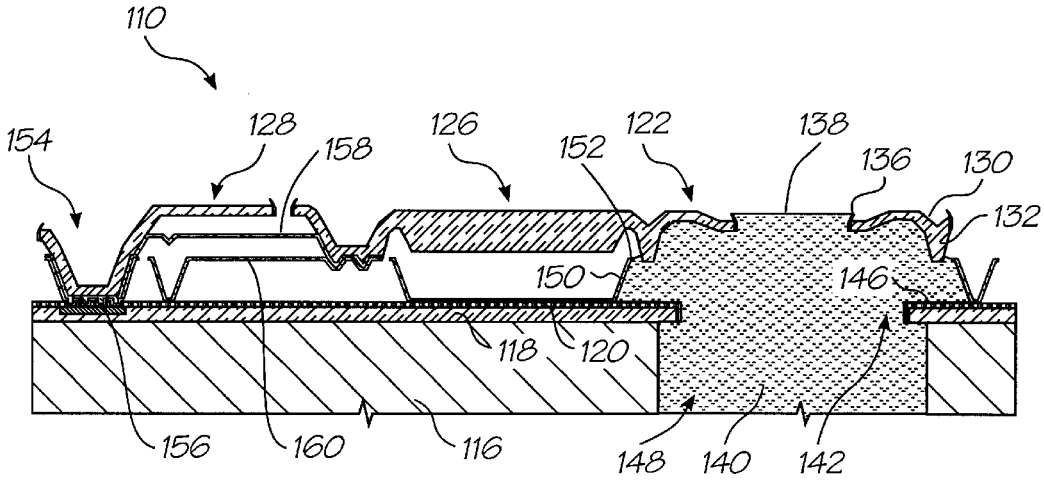
FIGS. 30*a* to 30*c* show sectional side views of an operation of the nozzle assembly manufactured according to the method of FIGS. 26 and 27.
Figure 29B:
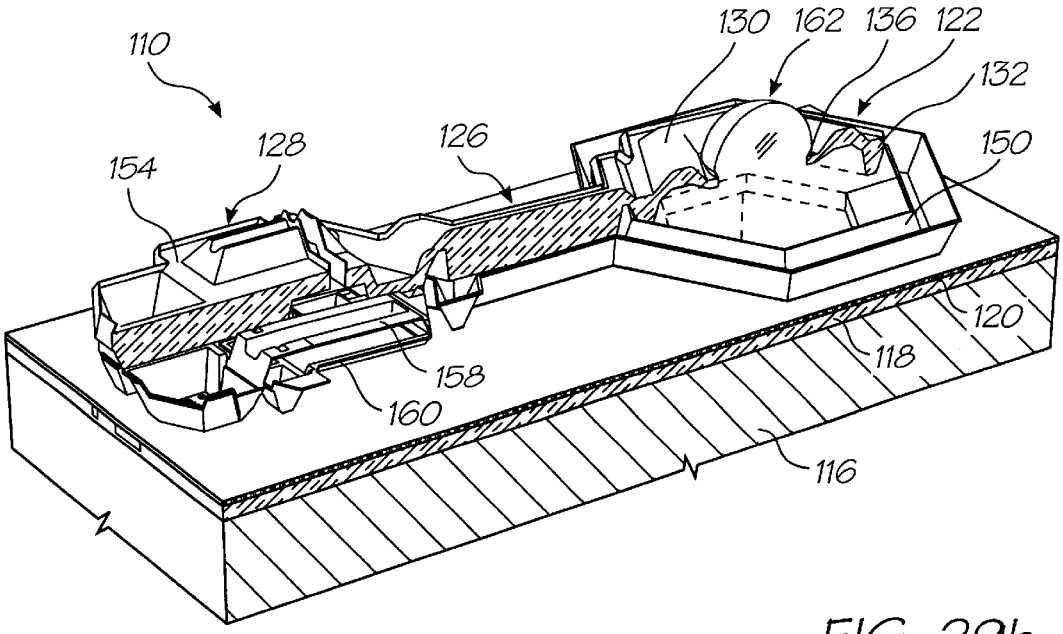
Figure 30B:
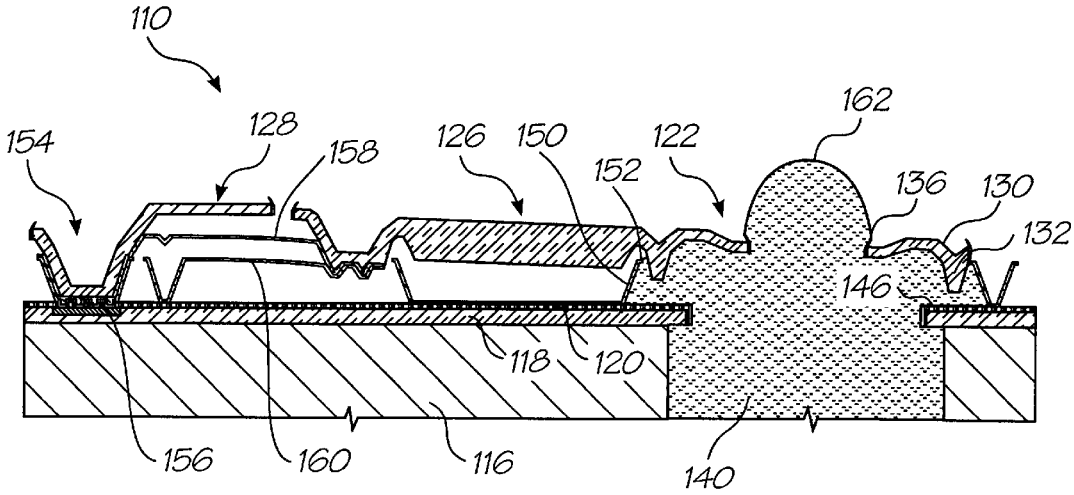
Figure 29C:
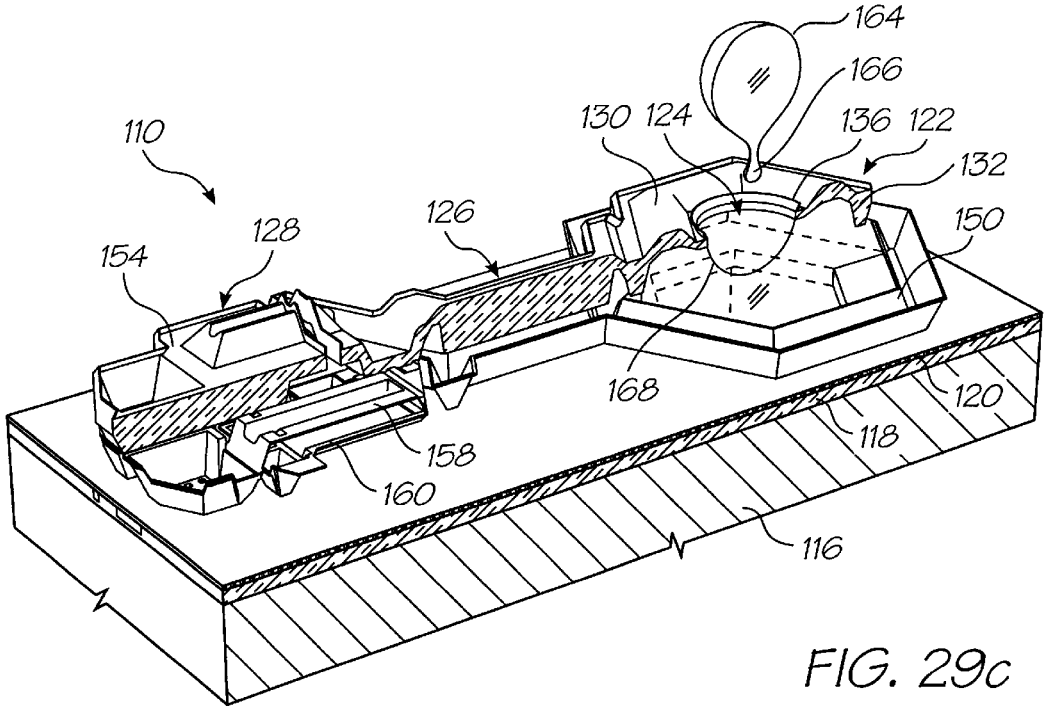
Figure 30C:
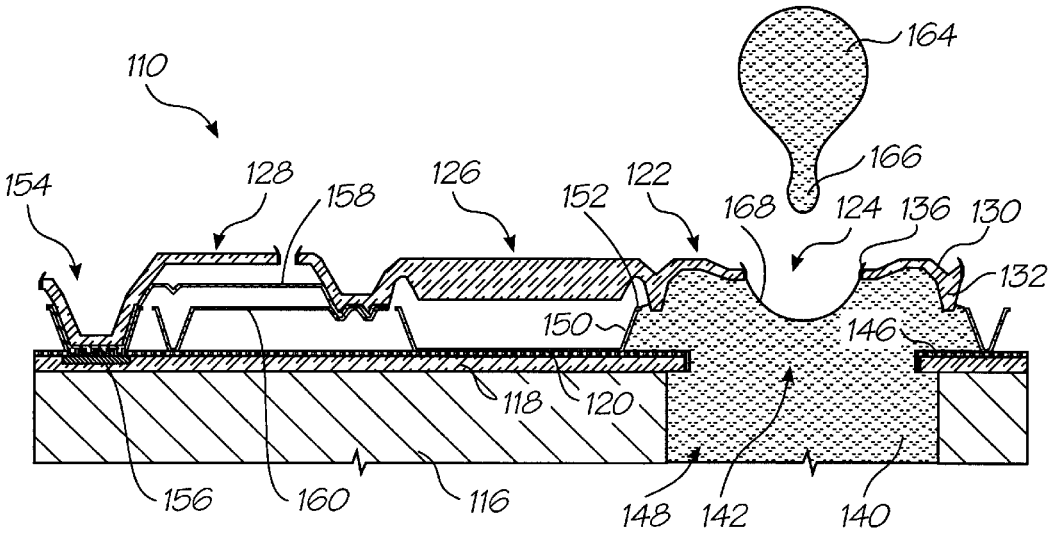

A further UV release tape (not shown) is applied to a rear of the wafer 16 and the tape 240 is removed. The sacrificial layers 208, 212, 220, 228 and 234 are stripped in oxygen plasma to provide the final nozzle assembly 110 as shown in FIGS. 26*r* and 27*r* of the drawings. For ease of reference, the reference numerals illustrated in these two drawings are the same as those in FIG. 19 of the drawings to indicate the relevant parts of the nozzle assembly 110. FIGS. 29 and 30 show the operation of the nozzle assembly 110, manufactured in accordance with the process described above with reference to FIGS. 26 and 27, and these figures correspond to FIGS. 20 to 22 of the drawings.

The presently disclosed ink jet printing technology is potentially suited to a wide range of printing systems including: color and monochrome office printers, short run digital printers, high speed digital printers, offset press supplemental printers, low cost scanning printers, high speed pagewidth printers, notebook computers with inbuilt pagewidth printers, portable color and monochrome printers, color and monochrome copiers, color and monochrome facsimile machines, combined printer, facsimile and copying machines, label printers, large format plotters, photograph copiers, printers for digital photographic 'minilabs', video printers, PHOTO CD (PHOTO CD is a registered trade mark of the Eastman Kodak Company) printers, portable printers for PDAs, wallpaper printers, indoor sign printers, billboard printers, fabric printers, camera printers and fault tolerant commercial printer arrays.

It would be appreciated by a person skilled in the art that numerous variations and/or modifications may be made to the present invention as shown in the preferred embodiment without departing from the spirit or scope of the invention as broadly described. The preferred embodiment is, therefore, to be considered in all respects to be illustrative and not restrictive.

I claim:

1. An ink jet nozzle assembly including:

a nozzle chamber having an inlet in fluid communication with an ink reservoir and a nozzle through which ink from the chamber can be ejected;

the chamber including a fixed portion and a movable portion configured for relative movement in an ejection phase and alternate relative movement in a refill phase;

the movable portion including a plurality of thermal actuator petal devices arranged around a central stem, said petal devices undergoing bending upon heating to effect periodically said relative movement; and the inlet being positioned and dimensioned relative to the nozzle such that ink is ejected preferentially from the chamber through the nozzle in droplet form during the ejection phase, and ink is alternately drawn preferentially into the chamber from the reservoir through the inlet during the refill phase.

2. An assembly according to claim 1 wherein the movable portion includes the nozzle and the fixed portion is mounted on a substrate.

3. An assembly according to claim 1 wherein the fixed portion includes the nozzle mounted on a substrate and the movable portion includes the petal devices.

4. An assembly according to claim 1 wherein said petal devices bend generally toward said ink ejection port.

5. An assembly according to claim 4 wherein a surface of said petal devices which is to bend in a convex form is hydrophobic.

6. An assembly according to claim 4 wherein a surface of said petal device which is to bend in a concave form is hydrophilic.

7. An assembly according to claim 1 wherein said petal devices comprise a first material having a high coefficient of thermal expansion surrounding a second material which conducts resistively so as to provide for heating of said first material.

8. An assembly according to claim 7 wherein said second material is constructed so as to concertina upon expansion of said first material.

9. An assembly according to claim 7 wherein said first material comprises substantially polytetrafluoroethylene.

10. An assembly according to claim 7 wherein said second material comprises substantially copper.

11. An assembly according to claim 1 wherein, during operation, an air bubble forms under said petal devices.

12. An assembly according to claim 1 wherein a space between adjacent petal devices is reduced upon said bending upon heating.

13. An assembly according to claim 1 wherein the petal devices are attached to a substrate and heating of said petal devices is primarily near an attached end of each said petal device.

14. An assembly according to claim 1 wherein an outer surface of said ink chamber includes a plurality of etchant holes provided so as to allow rapid etching of a sacrificial layer during construction.

15. An assembly according to claim 1, manufactured using micro-electro-mechanical systems (MEMS) techniques.

16. An assembly according to claim 1, wherein the nozzle chamber has a wall having the nozzle formed therein, the wall being less than about 5 μm thick.

17. An assembly according to claim 16 wherein the wall is less than about 2 μm thick.

18. An assembly according to claim 16, manufactured using micro-electro-mechanical system (MEMS) techniques.

* * * * *